US008136697B2

(12) United States Patent
Hackney

(10) Patent No.: US 8,136,697 B2
(45) Date of Patent: Mar. 20, 2012

(54) GRAVITY FED DISPENSING CONTAINER

(75) Inventor: Clark K. Hackney, Midlothian, TX (US)

(73) Assignee: International Paper Company, Memphis, TN (US)

( * ) Notice: Subject to any disclaimer, the term of this patent is extended or adjusted under 35 U.S.C. 154(b) by 525 days.

(21) Appl. No.: 12/151,000

(22) Filed: May 2, 2008

(65) Prior Publication Data

US 2009/0272756 A1 Nov. 5, 2009

(51) Int. Cl.
*A47F 1/04* (2006.01)
*B65D 83/00* (2006.01)

(52) U.S. Cl. ..... 221/305; 221/303

(58) Field of Classification Search ..... 221/30–34, 221/45, 46, 56, 59–64, 68, 69, 92, 151, 152, 221/175, 176, 197, 281, 282, 286, 287, 303, 221/305, 312 C
See application file for complete search history.

(56) References Cited

U.S. PATENT DOCUMENTS

| | | | | | |
|---|---|---|---|---|---|
| 1,189,779 | A | | 7/1916 | Becker | |
| 1,682,838 | A | | 9/1928 | Feigelman | |
| 1,889,232 | A | * | 11/1932 | Ware | 221/64 |
| 1,898,646 | A | * | 2/1933 | Taylor | 229/122.1 |
| 1,966,676 | A | | 7/1934 | Marsh | |
| 1,972,406 | A | | 9/1934 | Marsh | |
| 1,974,926 | A | | 9/1934 | Marsh | |
| 2,126,461 | A | * | 8/1938 | Graham | 206/731 |
| RE21,398 | E | * | 3/1940 | Nils Thor | 221/55 |
| 2,216,324 | A | * | 10/1940 | Ringler | 221/45 |
| 2,299,027 | A | * | 10/1942 | Novak | 229/122.1 |
| 2,663,490 | A | * | 12/1953 | Bernard et al. | 229/120.04 |
| 3,040,952 | A | * | 6/1962 | Garman | 229/121 |
| 3,156,378 | A | * | 11/1964 | Bua | 221/197 |
| 3,204,762 | A | | 9/1965 | Shanok et al. | |
| 3,450,308 | A | * | 6/1969 | Schoenefeld | 221/305 |
| 4,170,325 | A | * | 10/1979 | Pawlowski et al. | 206/526 |
| 4,382,526 | A | * | 5/1983 | Stone | 221/34 |
| 4,530,548 | A | * | 7/1985 | Spamer et al. | 312/45 |
| 4,538,726 | A | * | 9/1985 | Pastva | 206/449 |
| 4,643,334 | A | * | 2/1987 | Steele | 221/63 |
| 4,767,022 | A | * | 8/1988 | Oldorf | 221/92 |
| 4,805,765 | A | | 2/1989 | Barrett et al. | |
| D302,949 | S | * | 8/1989 | Eisendrath | D9/733 |
| 5,322,185 | A | * | 6/1994 | Leight | 221/2 |
| 5,447,253 | A | * | 9/1995 | Williams | 221/92 |
| 5,642,837 | A | * | 7/1997 | Hayes et al. | 221/197 |
| 5,887,707 | A | * | 3/1999 | Anascavage et al. | 206/63.5 |
| 6,168,088 | B1 | | 1/2001 | Mobley | |
| 6,189,729 | B1 | * | 2/2001 | Keller | 221/45 |
| 6,237,757 | B1 | | 5/2001 | Alpern | |
| D619,891 | S | * | 7/2010 | Lymn et al. | D9/432 |
| 2004/0011859 | A1 | * | 1/2004 | Lo Duca | 229/120.18 |

* cited by examiner

*Primary Examiner* — Gene Crawford
*Assistant Examiner* — Kelvin L Randall, Jr.
(74) *Attorney, Agent, or Firm* — Matthew M. Eslami

(57) ABSTRACT

A gravity fed dispensing and display box has separate partition inserts therein dividing the interior into a plurality of compartments for stacking articles to be dispensed. A dispensing opening at the bottom of each compartment has a width less than the width of the compartment and of articles to be dispensed to prevent unintentional movement of an article through the opening. A yieldable retaining panel overlies the articles in each compartment to prevent loss of articles through the top during shipping, but flexes downwardly to enable an article to be placed in the compartment through the top. A lid is convertible from a shipping closure to a display panel for display at a point of sale. The box and the inserts are each held assembled by interlocking tabs and slots, avoiding the need for adhesive.

16 Claims, 9 Drawing Sheets

GRAVITY FED DISPENSING CONTAINER

TECHNICAL FIELD

This invention relates generally to packaging, and more particularly to a gravity fed dispensing container.

BACKGROUND ART

Many products are shipped in containers that can be used to dispense the product when it reaches a point of sale. Exemplary of such containers are those disclosed in U.S. Pat. Nos. 1,896,646 and 1,966,676.

The dispensing container disclosed in the '646 patent comprises a display box and separate partition members inserted into the box to define a plurality of compartments in which articles to be dispensed are stacked. Dispensing openings are provided in the front of the box at the base of the compartments for withdrawing articles from the bottom of the respective stacks. These openings have the same width as the width of the compartments. Window openings are also provided in the front of the box, through with the articles supported in the stacks can be viewed, and these openings are of less width than the compartments. The box is held assembled by glue panels, and the partition inserts are secured by interfitting tabs and slots on the inserts and box. A display panel extension on the top of the front wall of the box can be raised for display at the point of sale, or for shipping can be folded flat against the lid that closes the top of the box. The box and partition members are adapted to be shipped in a flattened condition and opened up and loaded with merchandise by the retailer. In a modification, a slight lip on the front wall extends up into the bottom of the dispensing opening to keep a bottom article from protruding through the opening or coming out entirely when not intended. However, because the width of the dispensing openings is the same as the width of the compartments, it is possible that when a bottom article is withdrawn through the opening a next adjacent article may also be inadvertently withdrawn.

The dispensing container disclosed in the '676 patent comprises a display box housing and separate cartridge members inserted into the box for holding merchandise and dispensing it through openings in the front of the box. The housing is adapted to receive two cartridges, each forming two compartments for stacking merchandise. A separate shelf unit is assembled to the bottom of the box for receiving the merchandise as it is dispensed through the openings. Adhesive is used to hold the dispensing container assembled. The container is particularly adapted for holding and dispensing canned goods, including different kinds of canned goods in the different compartments. The dispensing openings at the bottoms of the compartments appear to be of the same width as the compartments, whereby the lowermost article in a stack can move through the opening and onto the shelf.

It would be desirable to have a dispensing container for shipping merchandise and displaying it at a point of sale, wherein the container has at least one merchandise compartment with a dispensing opening at the bottom and means for preventing unintentional discharge or displacement of articles from the compartment, both during shipment and handling and while in use at the point of display and sale.

It would also be desirable to have a dispensing container that is held assembled by interfitting tabs and slots, whereby the use of adhesive is not necessary.

It would further be desirable to have a dispensing container that comprises a display box having at least one separate partition insert therein dividing the interior of the box into a plurality of stacking compartments, wherein the box and insert are each held assembled and are held assembled to each other by interfitting tabs and slots.

Another desirable feature would be to have a dispensing container that comprises a box having at least one compartment therein for stacking articles of merchandise, with a dispensing opening at the bottom for dispensing articles of merchandise, and a yieldable panel at the top for preventing loss of articles through the top of the compartment during shipping and handling, but enabling articles to be placed in the compartment through the top, with the panel yielding to guide the article into proper orientation as it falls into the compartment.

Yet another desirable feature would be to have a dispensing container with a lid or top cover that can be converted into an upstanding display panel by the simple act of opening the lid, folding it in half about a break line, and reinserting the lid flap into the container.

DISCLOSURE OF THE INVENTION

The present invention comprises a gravity fed dispensing container for shipping merchandise and displaying it at a point of sale, wherein the container has at least one merchandise compartment with a dispensing opening at the bottom, and means for preventing unintentional discharge or displacement of articles from the compartment both during shipping and handling and while in use at the point of display and sale. The means for preventing unintentional discharge or displacement of articles from the compartment comprises a reduced size dimension of the dispensing opening relative to a size dimension of the article to be dispensed, so that either the article or the opening, or both, must be flexed or deformed in order to withdraw the article through the opening. In a preferred embodiment the article is flexible, the reduced size dimension is a reduced width of the dispensing opening, and a rearwardly sloping front-facing panel is beneath the openings to enable the articles to be pulled downwardly and forwardly through the opening. The sloping front-facing panel also provides a graphics panel facing in an optimum direction for viewing by a customer.

In a preferred embodiment the dispensing container of the invention comprises a dispensing box having at least one separate partition insert therein dividing the interior of the box into a plurality of compartments or columns for stacking articles to be dispensed, wherein the box and insert are each held assembled and are held assembled to each other by interfitting tabs and slots, whereby the use of adhesive is not necessary. In a preferred embodiment two inserts are provided, each defining two stacking compartments.

The dispensing container of the invention comprises a dispensing box having at least one compartment therein for stacking articles of merchandise, with a dispensing opening at the bottom of the compartment through which the articles are dispensed, and a yieldable panel at the top that lies over a stack of articles in the compartment to prevent loss of articles through the top of the box during shipping and handling, but enabling articles to be placed in the compartment through the top, with the panel flexing downwardly to enable passage of the article and to guide the article into proper orientation as it falls into the compartment.

The dispensing container of the invention comprises a dispensing box with a lid or top cover pivoted along one edge to a back wall of the box, with a flap on a forward edge of the lid that is inserted into the box behind the front wall when the lid is pivoted closed across the top end of the box for shipping and storage, but which can be converted into an upstanding display panel by the simple act of opening the lid, folding it in half about a break line, and reinserting the lid flap into the container and against the back wall to hold the display panel erect.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

BEST MODE FOR CARRYING OUT THE INVENTION

Figure 1:
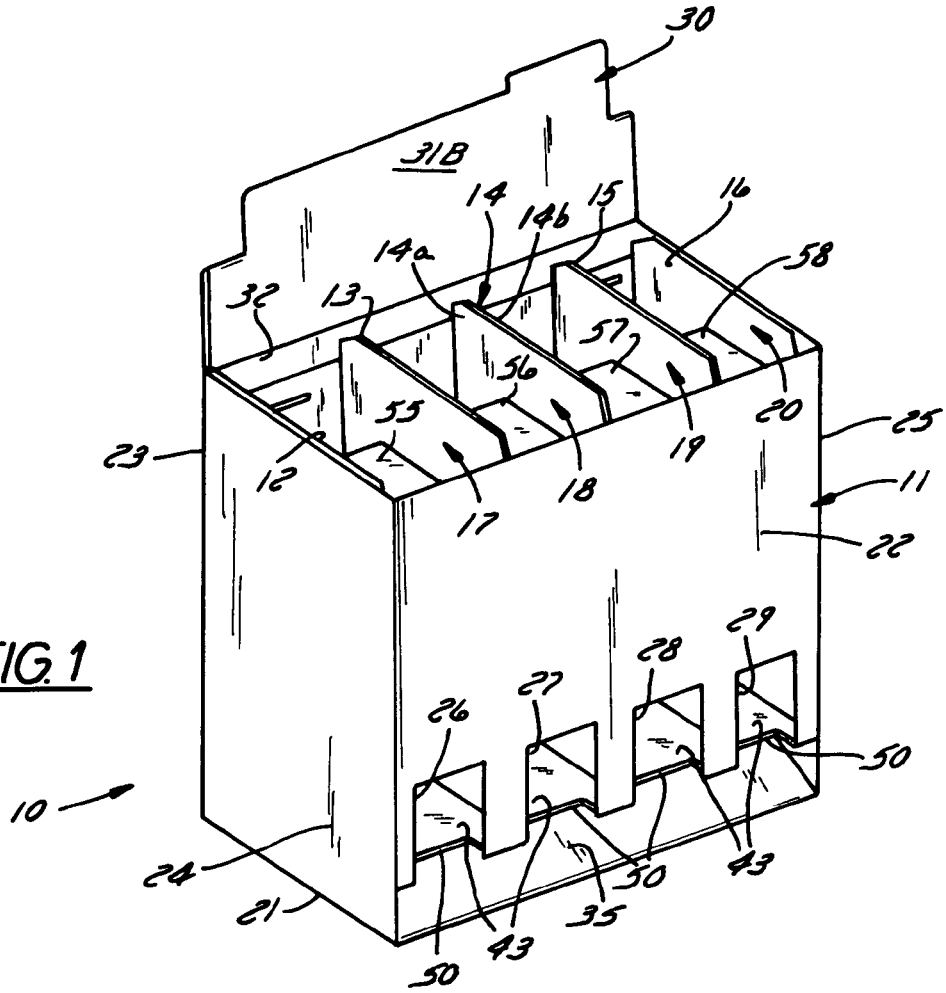
FIG. 1 is a perspective view of the dispensing container of the invention, looking toward the front of the container, and with the container in its display configuration.

A dispensing container according to the invention is indicated generally at 10 in FIG. 1, where the container is shown in its display configuration for use at a point of sale. The container comprises a dispensing box 11 having a plurality of partitions 12, 13, 14, 15 and 16 therein dividing the interior of the box into a plurality of compartments 17, 18, 19 and 20 for stacking articles of merchandise to be dispensed (not shown in this figure). The box has an outer bottom wall 21, a front wall 22, a back wall 23, and opposite end walls 24 and 25. A plurality of dispensing openings 26, 27, 28 and 29 are formed in a lower portion of the front wall, with each opening in aligned registry with a respective one of the compartments 17-20.

Figure 4:
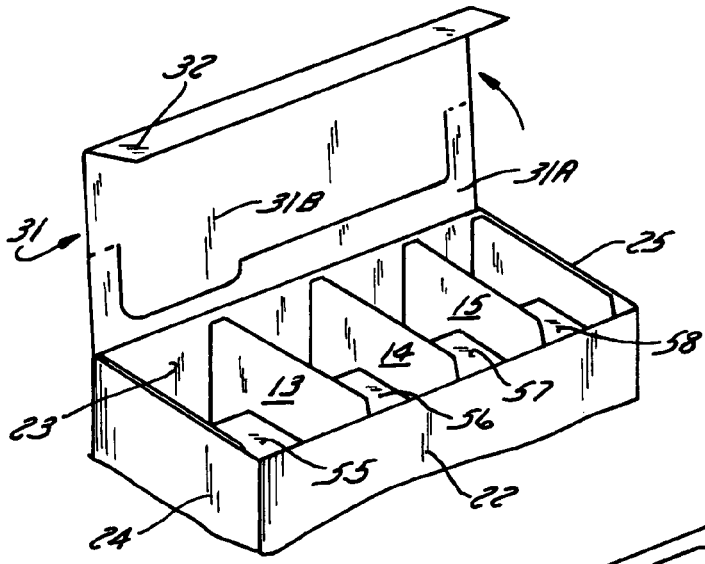
FIGS. 3-6 are fragmentary perspective views showing the steps involved in moving the lid of the container from its closed shipping position (FIG. 3) to its erect display position (FIG. 1).
Figure 3:
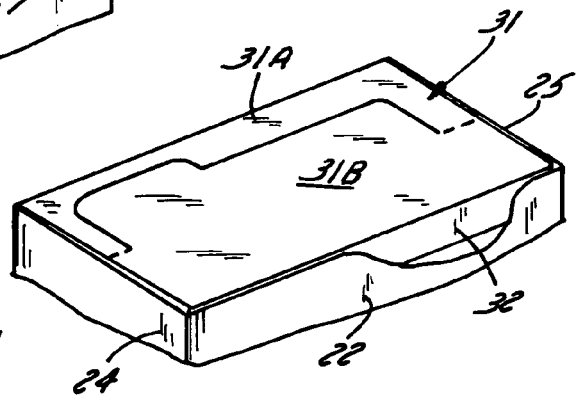
Figure 5:
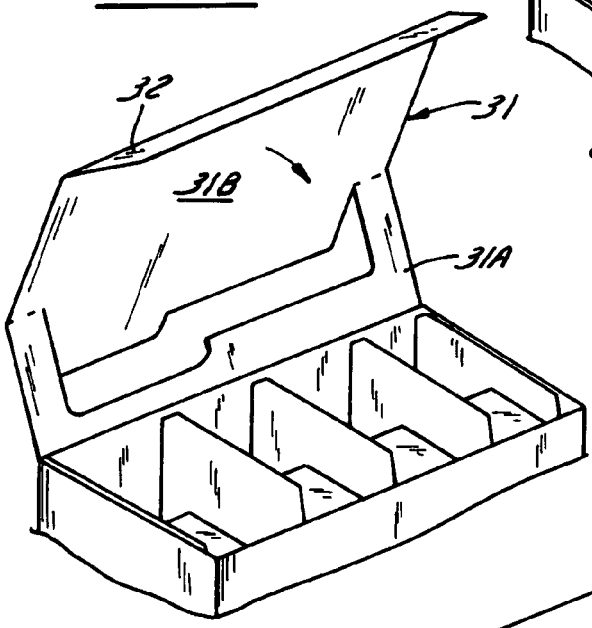
Figure 6:
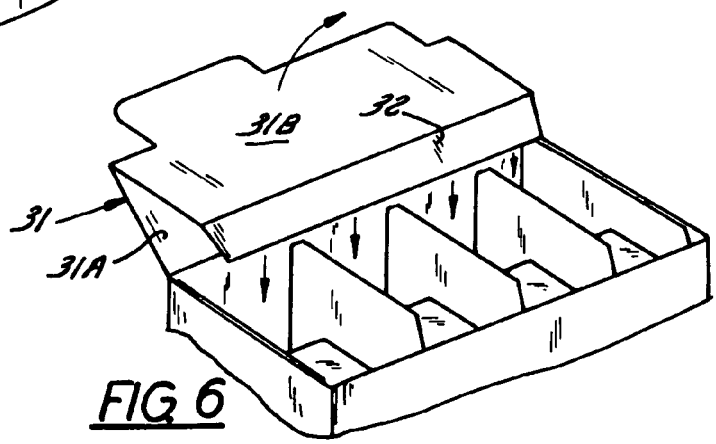

A display panel 30 projects upwardly from an upper edge of the back wall, and as seen best in FIGS. 3 and 4 the display panel is formed by reconfiguring a lid 31 pivotally attached to an upper edge of the back wall. The lid 31 has a down-turned flap 32 on its forward edge that is inserted into the container behind the front wall to hold the lid in a closed position over the top end of the box during shipping and handling, but as explained more fully hereinafter, the lid can be reconfigured from its closed shipping configuration shown in FIG. 3 to form the display panel 30 shown in FIG. 1.

An inclined panel 35 extends upwardly and rearwardly from the front edge of the outer bottom wall 21 and terminates at its upper edge in an inner bottom wall 36 that extends horizontally across the interior of the box in upwardly spaced relation to the outer bottom wall 21. The interior bottom wall is substantially coplanar with the open lower edge of the dispensing openings 26-29, but its forward edge 37, and the upper edge of the inclined panel, are spaced behind the front wall 22 (see FIGS. 24 and 25).

The partitions 12-16 and associated compartments 17-20 are formed by two inserts 40 and 41 (see FIGS. 2 and 15) that have bottom walls 42 and 43, respectively, front wall panels 44*a*, 44*b* and 45*a*, 45*b*, respectively, and open backs. Openings 46, 47 and 48, 49 are formed in the front wall panels 44*a*, 44*b* and 45*a*, 45*b*, respectively, and these openings are in aligned registry with the openings 26-29 in the front wall of the box when the inserts are placed in the box. The inserts are placed in the box so that the bottom walls 42 and 43 of the inserts rest on top of the interior bottom wall 36 of the box, and the front wall panels 44*a*, 44*b* and 45*a*, 45*b* lie against the inner surface of the box front wall.

As seen best in FIGS. 1, 2, 24 and 25, the forward edges of the bottom walls 42 and 43 of the inserts, in the area behind each dispensing opening, are recessed at 50 so that the recessed edges lie substantially in registry with the top edge of the rearwardly inclined panel 35.

Figure 25:
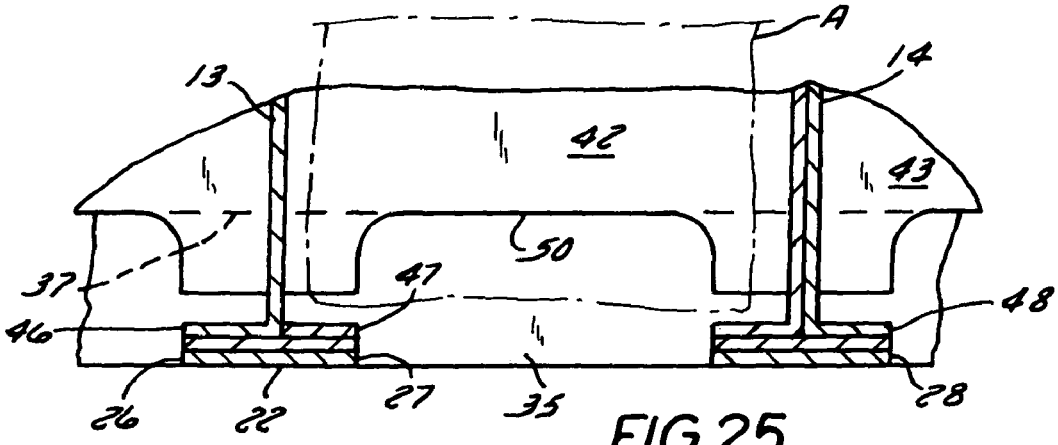
FIG. 25 is an enlarged fragmentary sectional view taken along line 25-25 in FIG. 23, showing in dot-and-dash lines an article to be dispensed.
Figure 1:
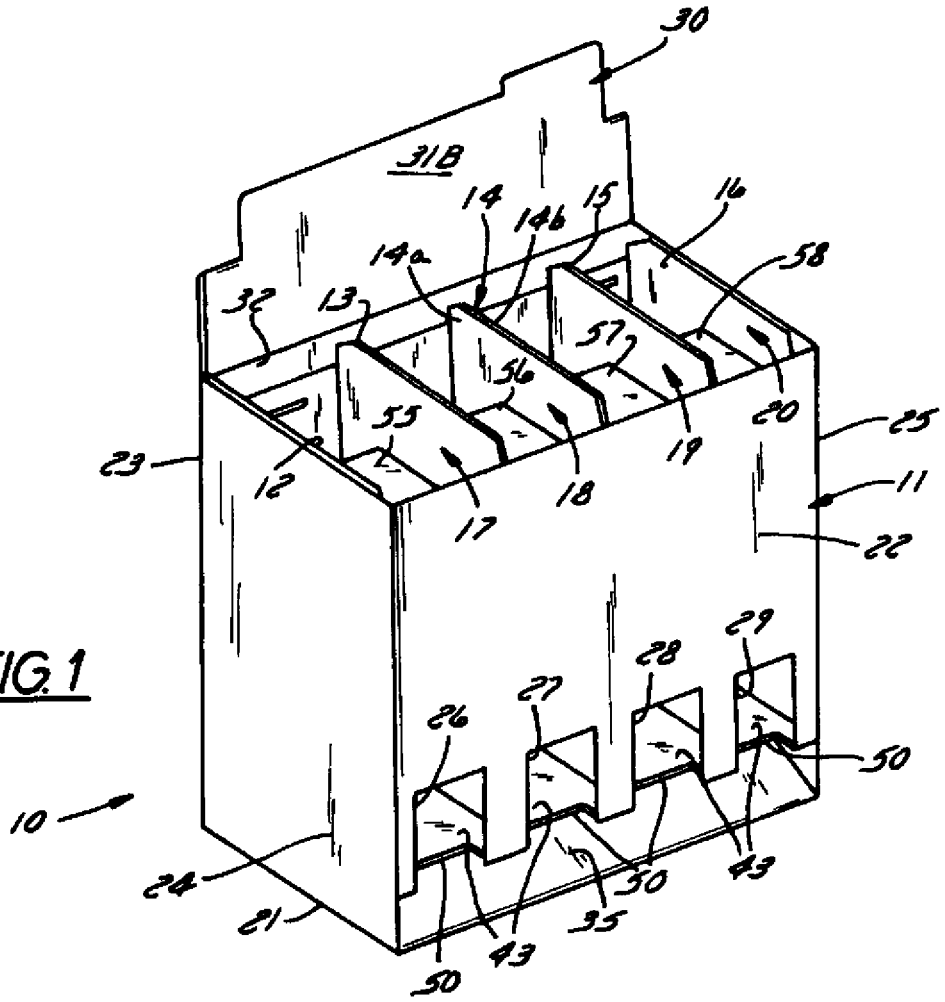
Figure 2:
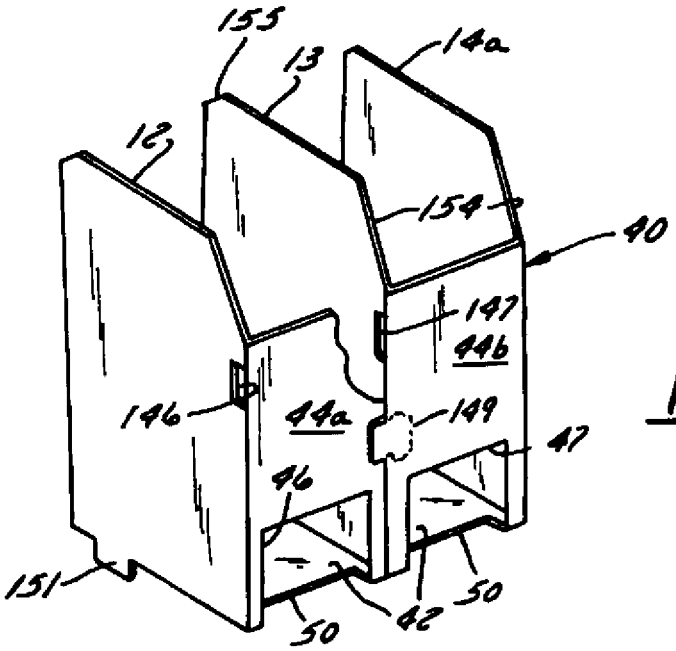
Figure 4:
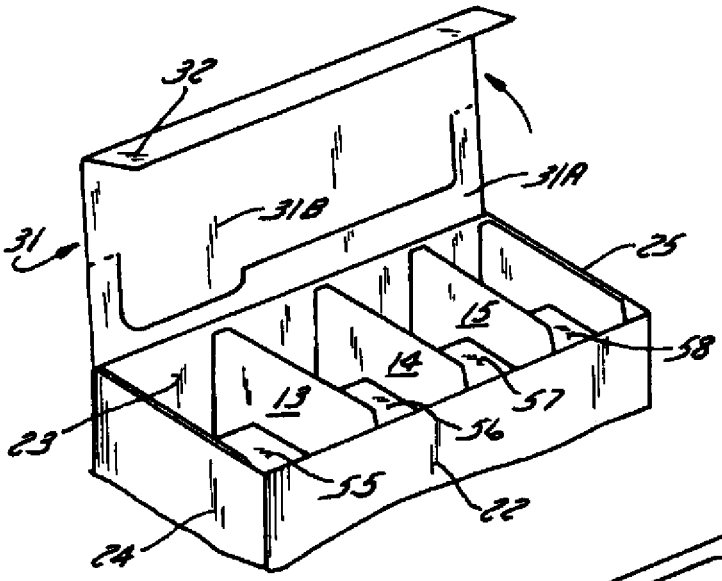
Figure 3:
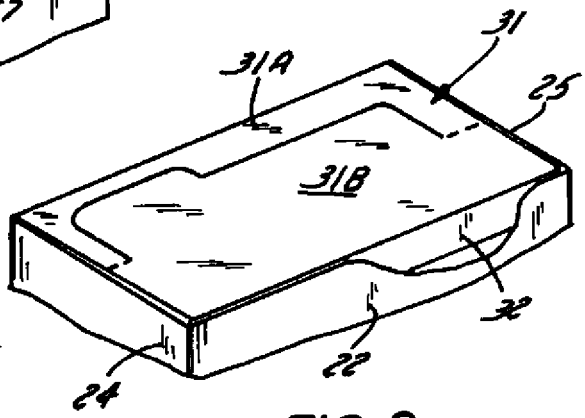
Figure 5:
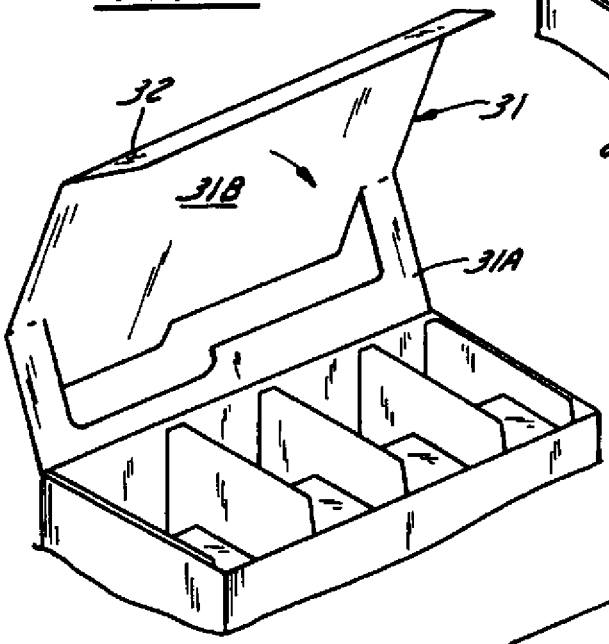
Figure 6:
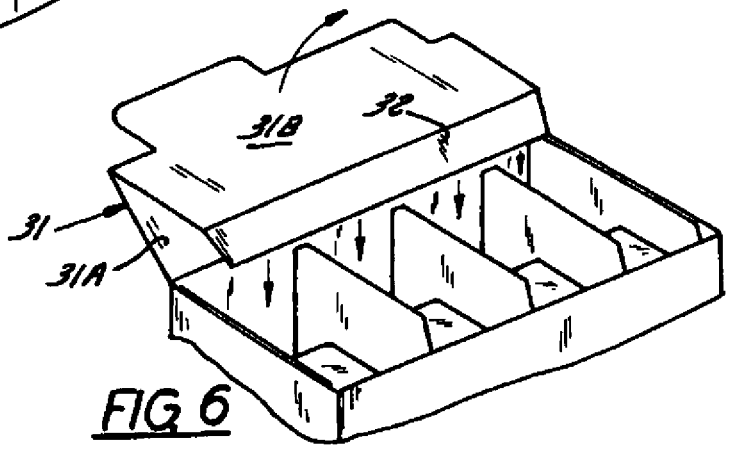
Figure 7:
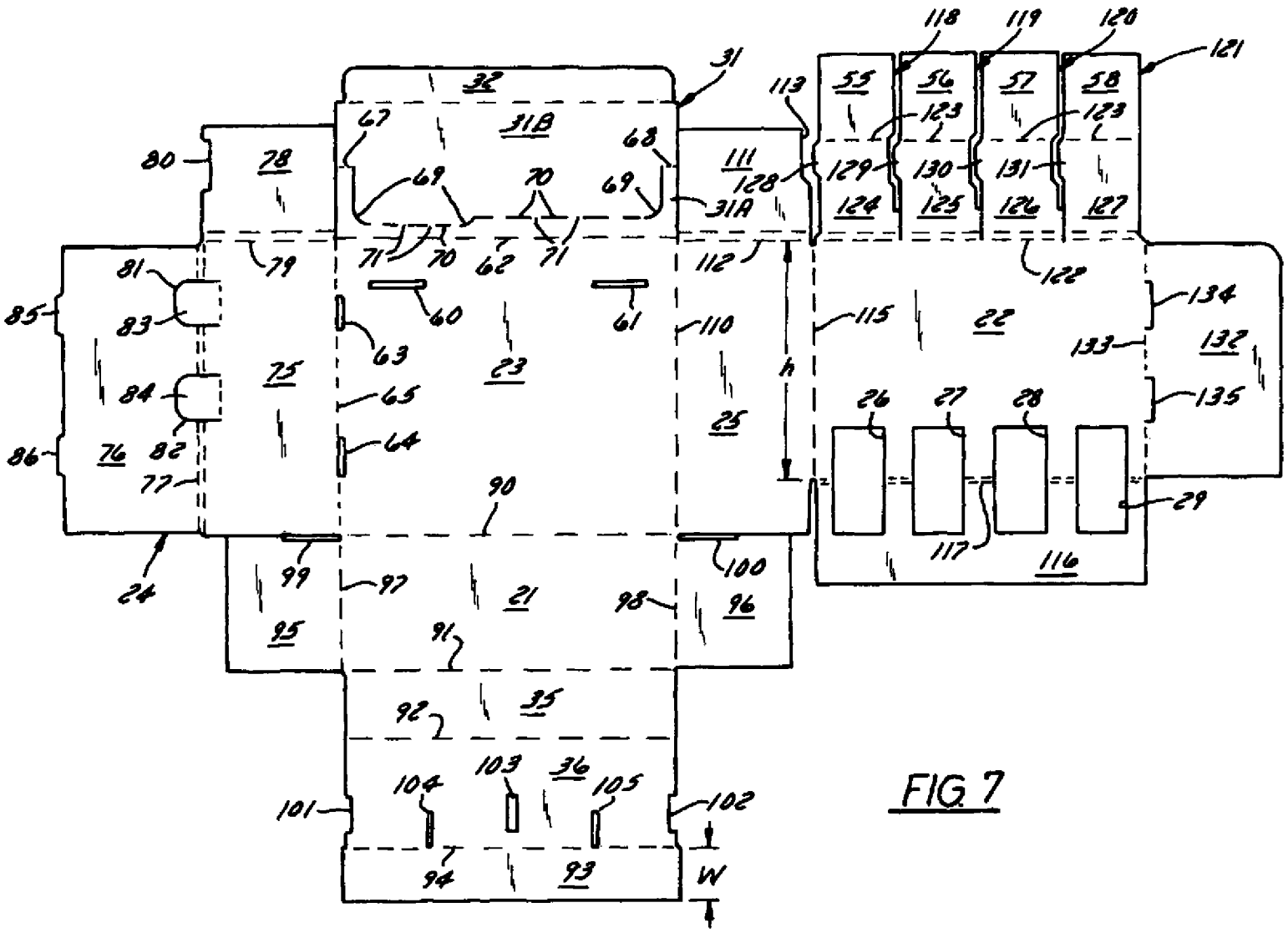
Figure 8:
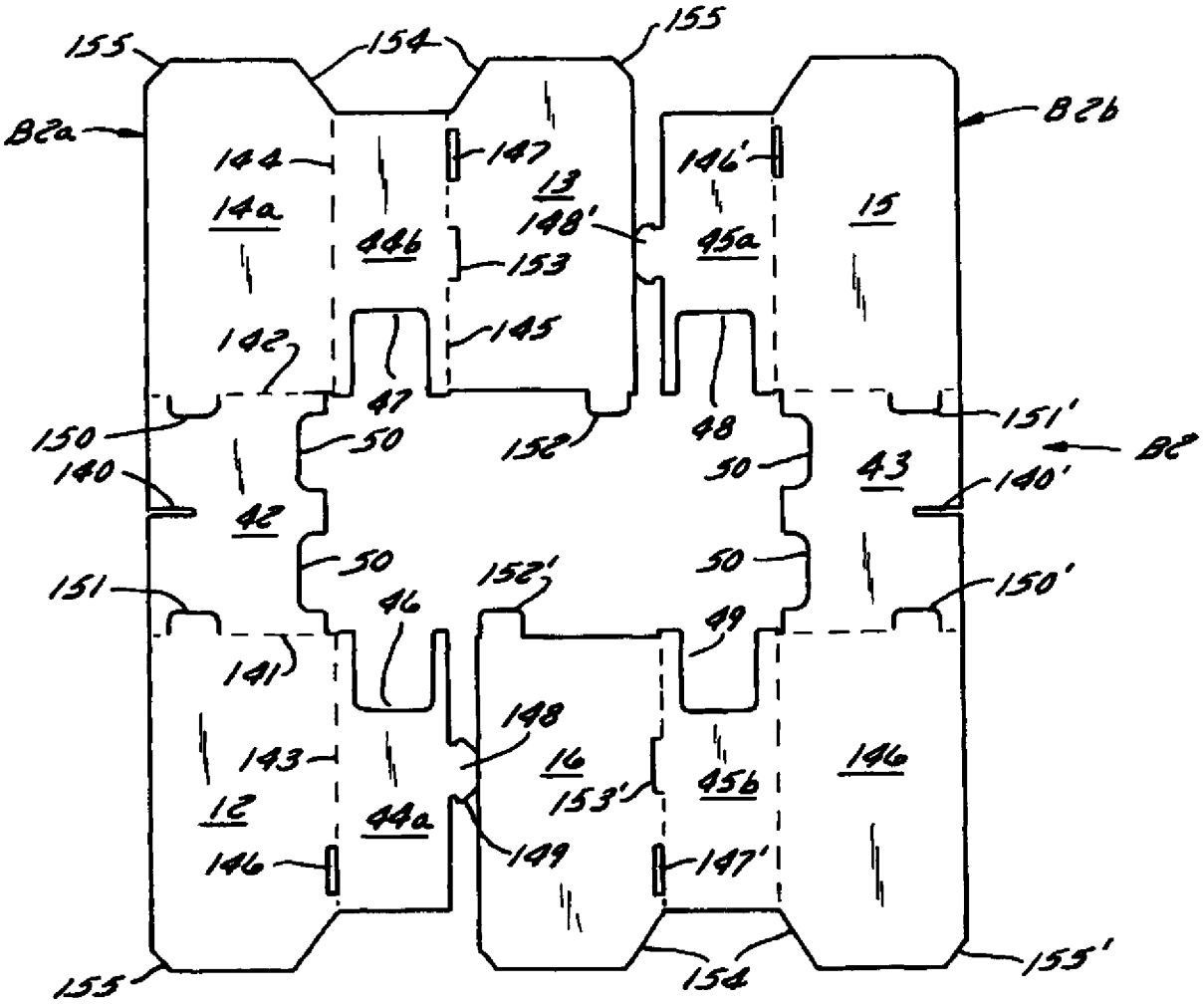
Figure 10:
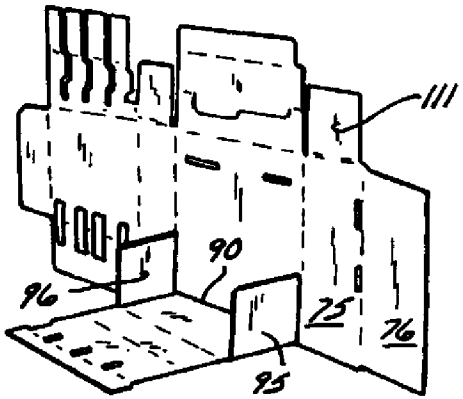
Figure 12:
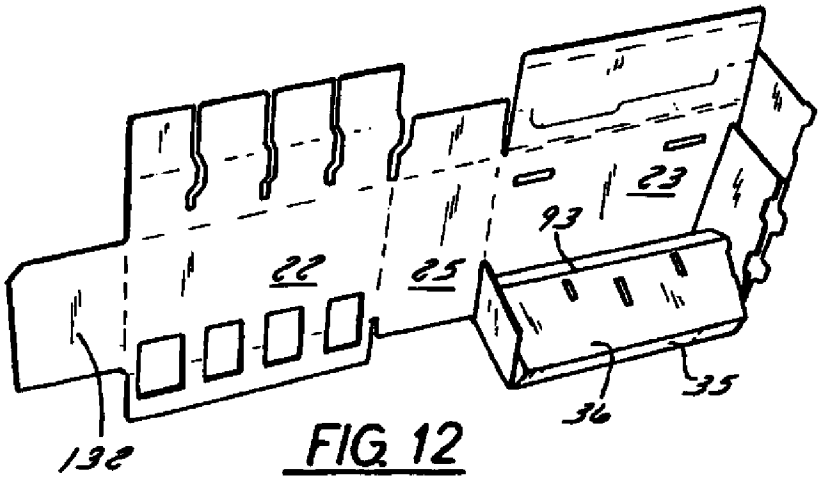
Figure 9:
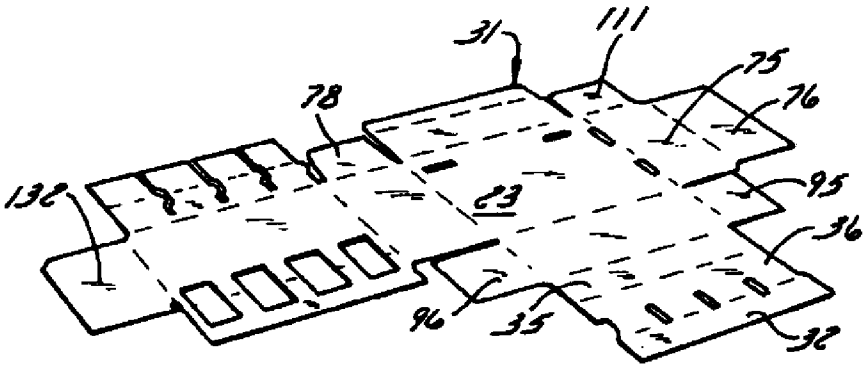
Figure 11:
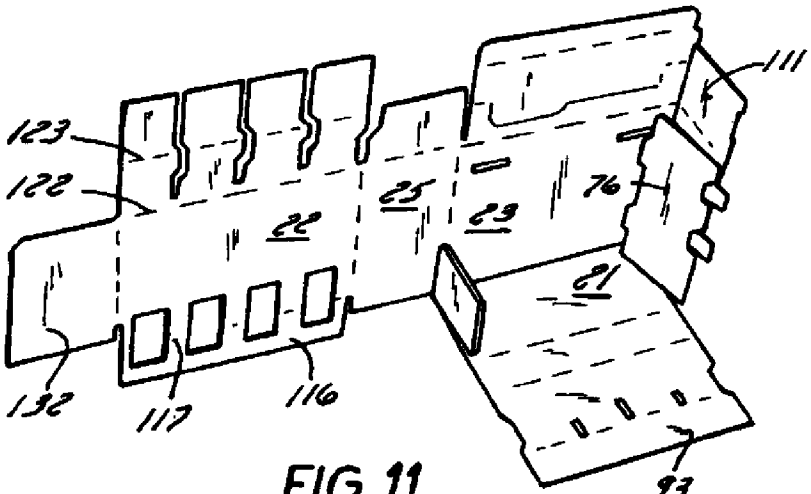
Figure 13:
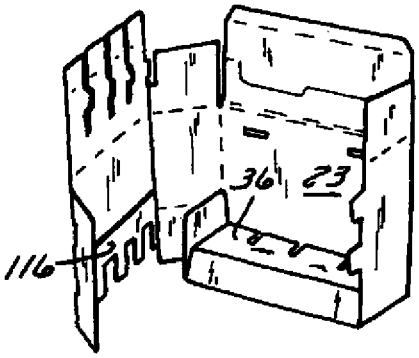
Figure 14:
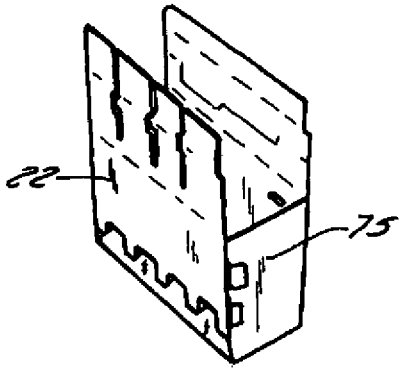
Figure 15:
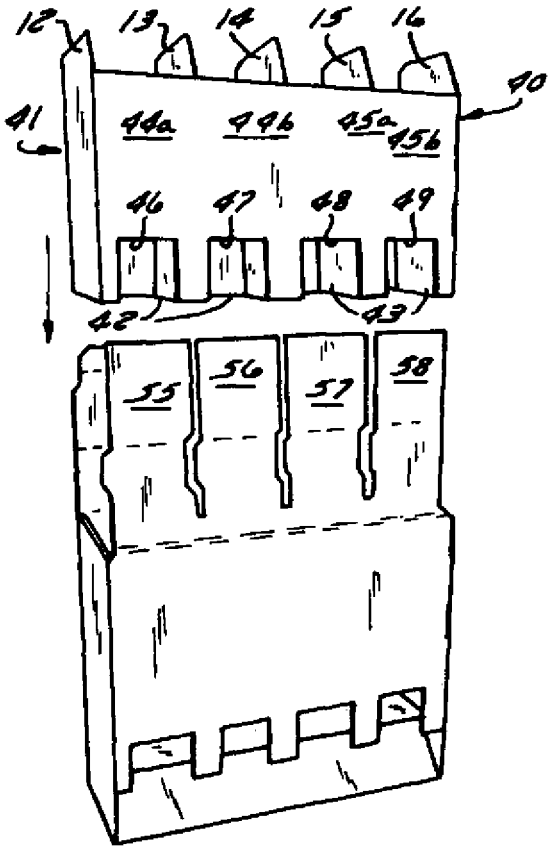
Figure 16:
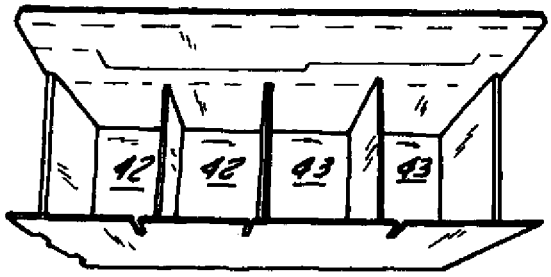
Figure 17:
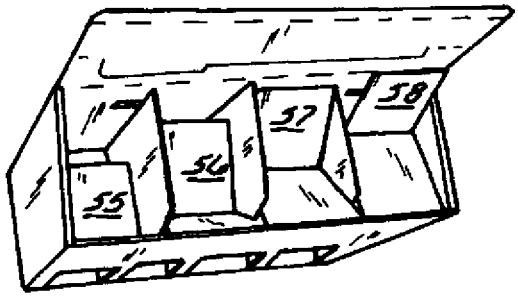
Figure 19:
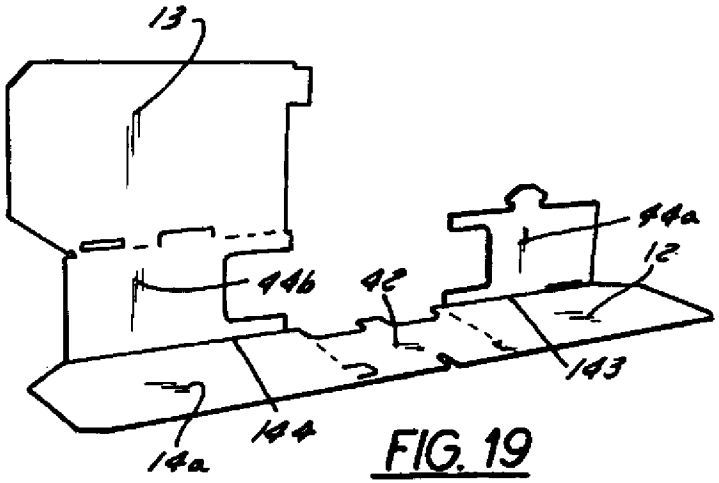
Figure 21:
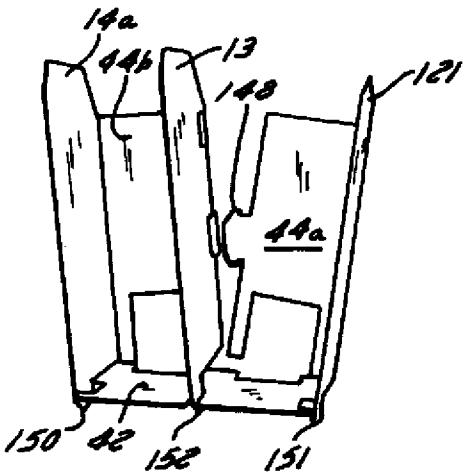
Figure 18:
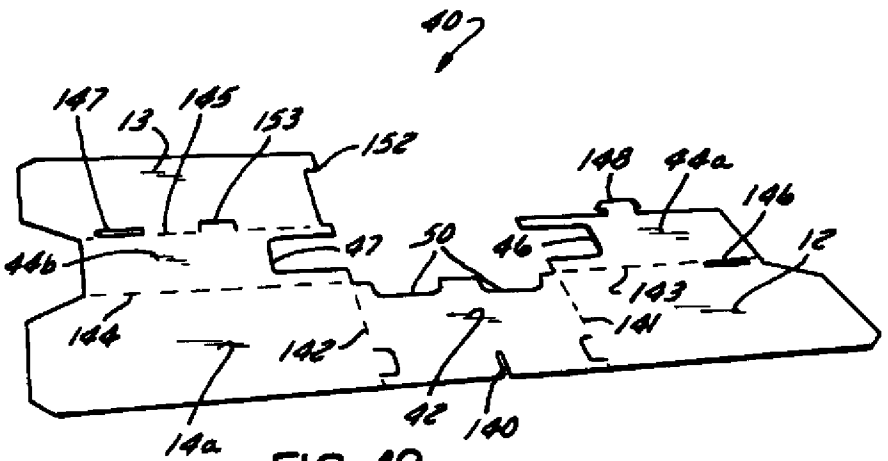
Figure 20:
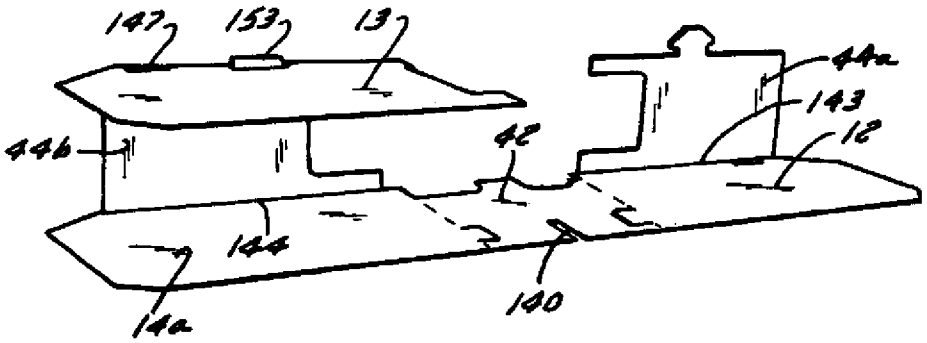
Figure 22:
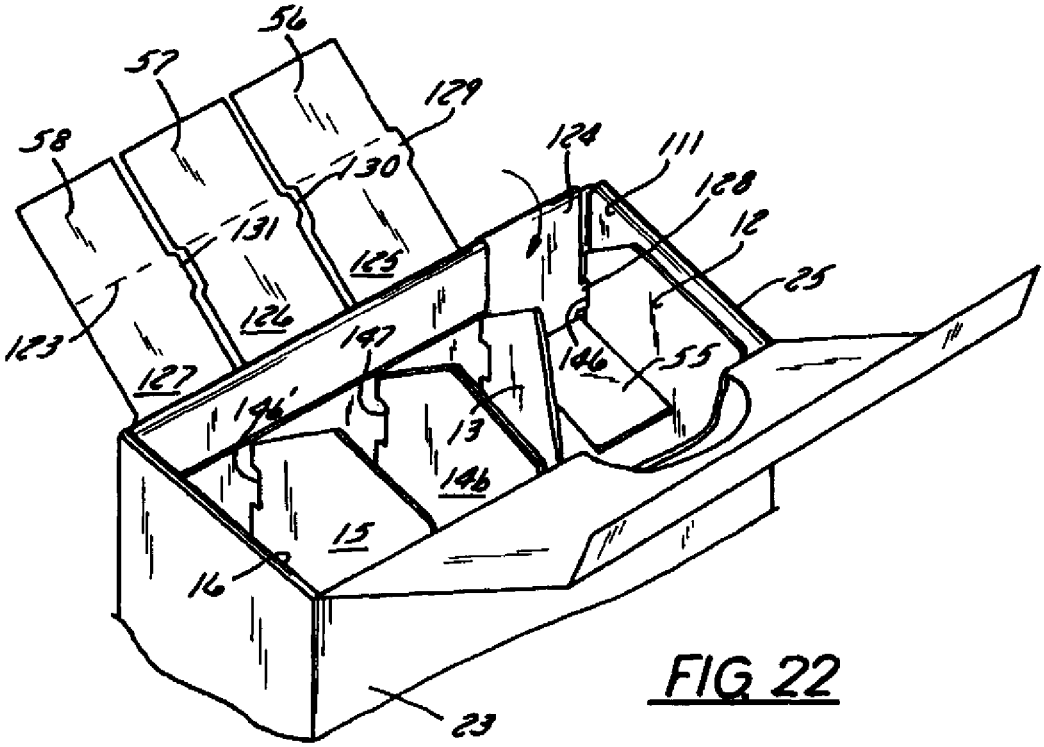
Figure 23:
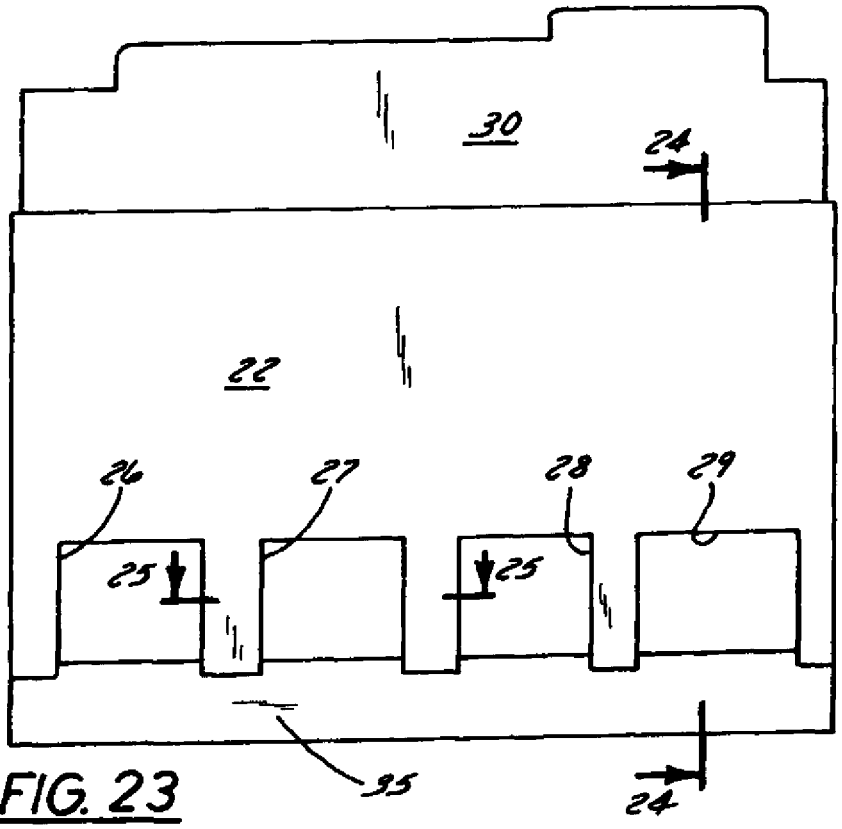
Figure 24:
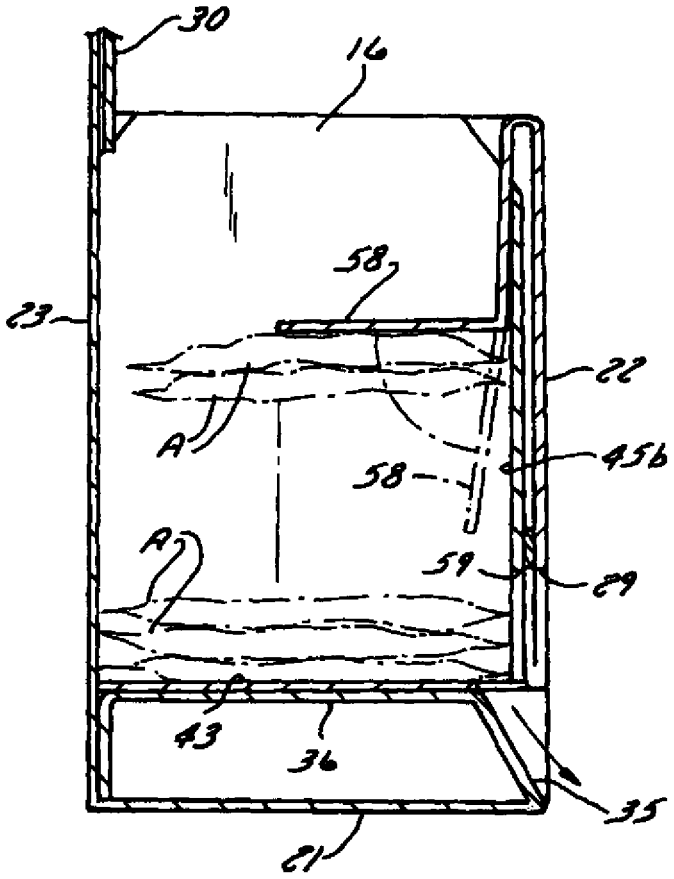
Figure 25:
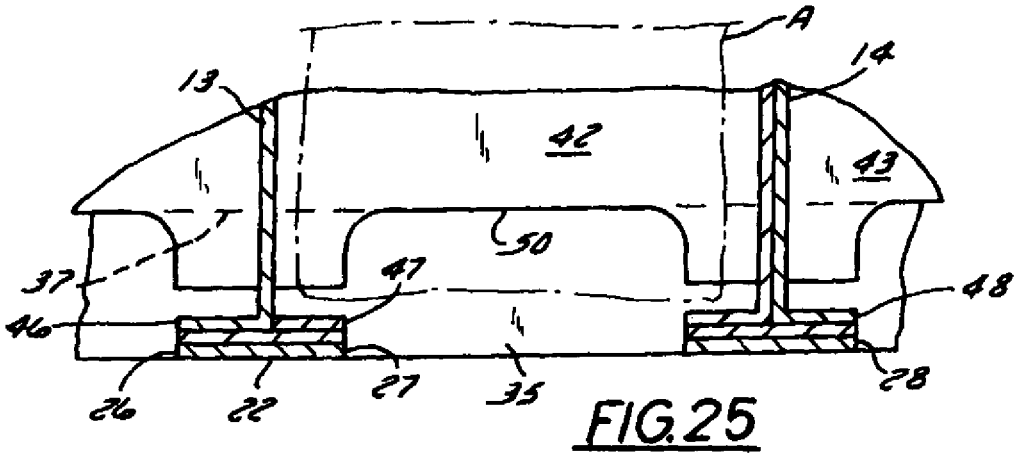

As seen best in FIG. 25 the width of the dispensing openings 26-29 and 46-49 is less than the width of the respective compartments as defined by the partitions. In a preferred embodiment it is contemplated that the articles "A" to be stacked in the compartments and dispensed through the openings will have a width slightly greater than the width of the openings whereby they will be restrained against inadvertent discharge through the openings, but they and/or the structure surrounding the openings can be slightly flexed to permit the articles to be withdrawn through the openings when desired.

Retaining and guiding panels 55, 56, 57 and 58 are foldably connected to the upper edge of the front wall 22 and are folded inwardly to extend between the partitions and lie over the tops of stacks of articles contained in the compartments. These panels resist upward deflection and thereby help to secure articles in the stack and prevent their ejection through the top ends of the compartments during shipping and handling, but they readily flex downwardly from their horizontal position and function to guide and align articles into proper orientation on a stack of articles in the compartment when articles are replaced in the compartments following initial filling (see FIG. 24).

The foregoing structure is well suited to stacking and dispensing small flat articles that are somewhat flexible or at least have flexible edges. The articles preferably have a width approximately the same as the width of the respective compartments, but slightly greater than the width of the dispensing openings. To remove a bottom article from a stack of the articles in one of the compartments, the front edge of the article is grasped and pulled forwardly and slightly downwardly against the inclined panel, causing the opposite side edges of the article to deflect and enabling the article to be withdrawn through the opening. The slight oversize of the articles prevents them from unintentionally passing through the dispensing openings during shipping and handling. Further, when a bottom article is being withdrawn from the stack the next adjacent article is held in place by the side edges of the opening and is not inadvertently withdrawn along with the article selected.

Figure 7:
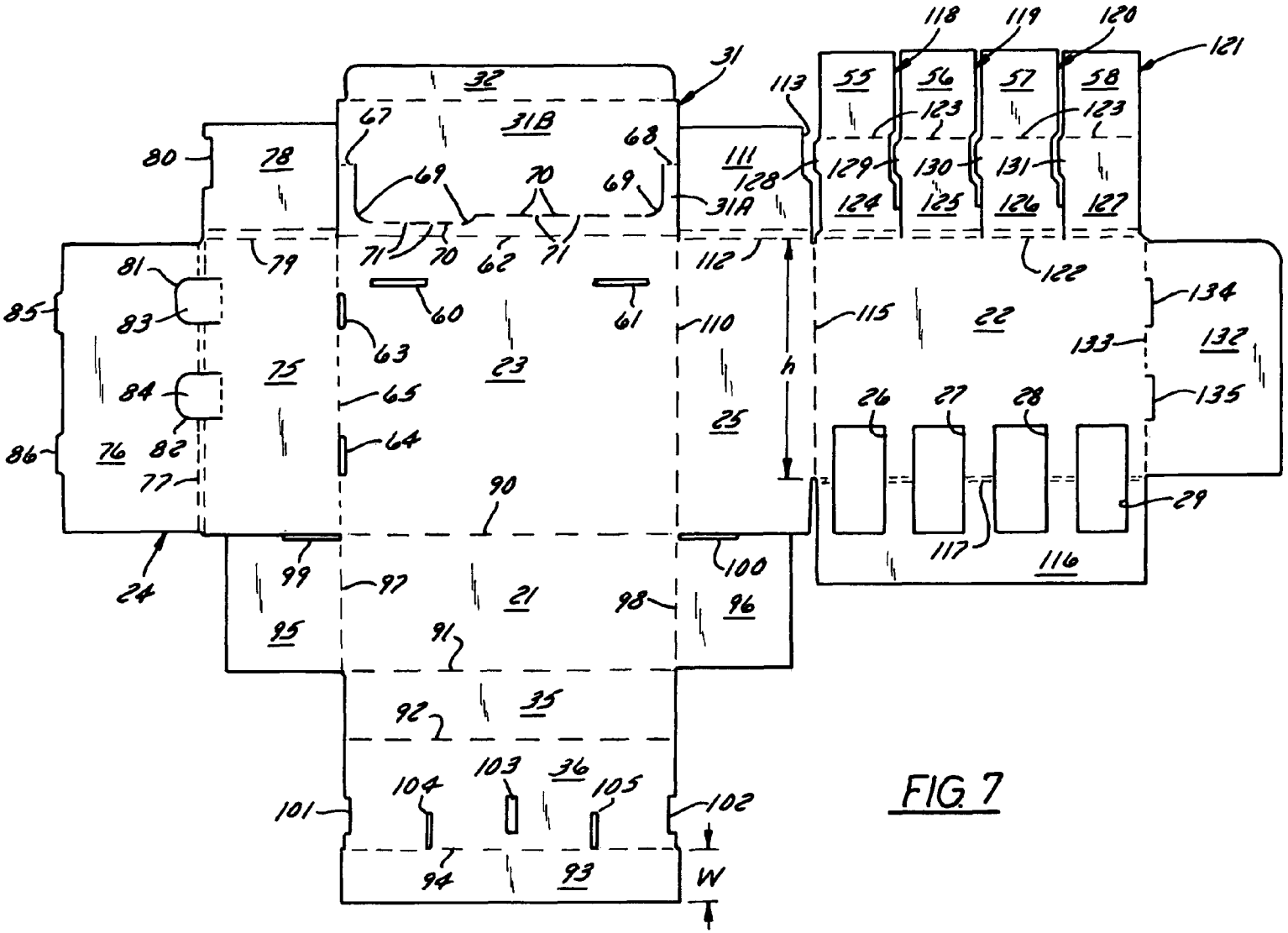
FIG. 7 is an outside plan view of a blank for making the dispensing box of the invention.

A blank B1 for making the dispensing box 11 in the container of the invention is shown in FIG. 7. The blank comprises a single piece of paperboard, cut and scored to define a rear wall panel 23 that forms the rear wall in the erected box. In a preferred embodiment the paperboard comprises E-flute Brite Top (white liner board) having an edge crush test value (ECT) of 32, folded and cut so that the corrugations extend vertically in the erected box. It should be understood, however, that other suitable materials could be used depending upon the characteristics desired. A pair of slots 60 and 61 is formed in the panel 23 near a fold line 62 that defines the top edge of the rear wall in a box erected from the blank, and these slots can be used to hang the dispensing container from hooks or other support devices at the point of sale. A second pair of smaller slots 63 and 64 is formed in the panel 23 closely adjacent a fold line 65 at one side edge of the panel, for a purpose hereinafter described.

A lid panel 31 is foldably attached to the rear wall panel 23 along the fold line 62, and a lid flap panel 32 is foldably attached to the free edge of panel 31 along a fold line 66. Short scores 67 and 68 substantially along a midline of panel 31 at its opposite side edges define hinges, and a series of cuts 69 and closely spaced slits 70 extend between the scores 67 and 68 to define a break line. The hinges and break line divide the lid panel into two parts, 31A and 31B that can be folded relative to one another to reconfigure the lid into the display panel 30 as explained more fully hereinafter. The connecting material 71 between the closely spaced slits prevent the lid from folding about the break line until deliberate action is taken to fold the lid to produce the display panel 30.

An outer end wall panel 75 is foldably connected to the side edge of panel 23 along fold line 65, and an inner end wall panel 76 is foldably connected to the outer edge of panel 75 along fold line 77. Panels 75 and 76 form the end wall 24 in the erected box. A first top end wall flap 78 is foldably connected to an edge of panel 75 along fold line 79 and has a notch 80 cut in one side edge thereof. Shaped cuts 81 and 82 define locking tabs 83 and 84, respectively, extending across the fold line 77, and locking tabs 85 and 86 are formed on the outer free edge of panel 76.

An outer bottom wall panel 21 is foldably attached along a fold line 90 to the edge of the back wall panel 23 opposite the edge to which the lid panel is attached and forms the outer bottom wall in the erected box. Panel 35 is foldably connected along a fold line 91 at one edge thereof to the opposite edge of outer bottom wall panel 21 and forms the inclined panel 35 in the erected box. An inner bottom wall panel 36 is foldably connected along a fold line 92 at one edge thereof to the opposite edge of panel 35, and a flap panel 93 is foldably connected along a fold line 94 to the opposite edge of panel 36. First and second bottom end wall flaps 95 and 96 are foldably connected along fold lines 97 and 98, respectively, to opposite ends of the outer bottom wall panel 21, and the edges of these end wall flaps adjacent the fold line 90 have notches 99 and 100 therein, respectively. Similarly, notches 101 and 102 are formed in the outer end edges of panel 36 adjacent fold line 94, and a slot 103 is formed in panel 36 intermediate its ends and adjacent fold line 94. Additional slots 104 and 105 are formed in panel 36 adjacent the fold line 94 and intermediate the slot 103 and the opposite ends of the panel.

End wall panel 25 is foldably joined along a fold line 110 to the edge of panel 23 opposite the edge to which panel 75 is joined, and a second top end wall flap 111 is foldably joined along a fold line 112 to the edge of panel 25 adjacent the lid panel 31. An outer side edge of panel 111 is notched at 113.

Front wall panel 22 is foldably joined along a fold line 115 to the edge of panel 25 opposite the edge connected to panel 23 and a front wall flap 116 is foldably joined to one edge of panel 22 along a fold line 117 extending perpendicular to fold line 115, so that the panel 22 has a height "h" that is less than the height of the panel 23 by approximately the same dimension as the width "w" of flap panel 93. A plurality of cut-outs 26-29 extend equidistantly on opposite sides of the fold line 117 and form the dispensing openings 26-29 in the front wall of an erected box. A plurality of panels 118, 119, 120 and 121 are foldably joined along a fold line 122 to the edge of panel 22 opposite the edge to which front wall flap 116 is joined, and each is bisected by a fold line 123 that divides the panels into first portions 124, 125, 126 and 127, respectively, and second portions 55, 56, 57 and 58 that form the retaining and guiding panels 55, 56, 57 and 58 in a box erected from the blank. The panels 118, 119, 120 and 121 are separated from one another by shaped slots that form laterally projecting tabs 128, 129, 130 and 131 on one side edge of the respective panels.

An additional end wall panel 132 is foldably joined along a fold line 133 to the edge of panel 22 opposite the edge connected to panel 25, and this fold line is interrupted by two shaped cuts 134 and 135 that form slots in panel 132 when the panel is folded relative to panel 22.

Figure 8:
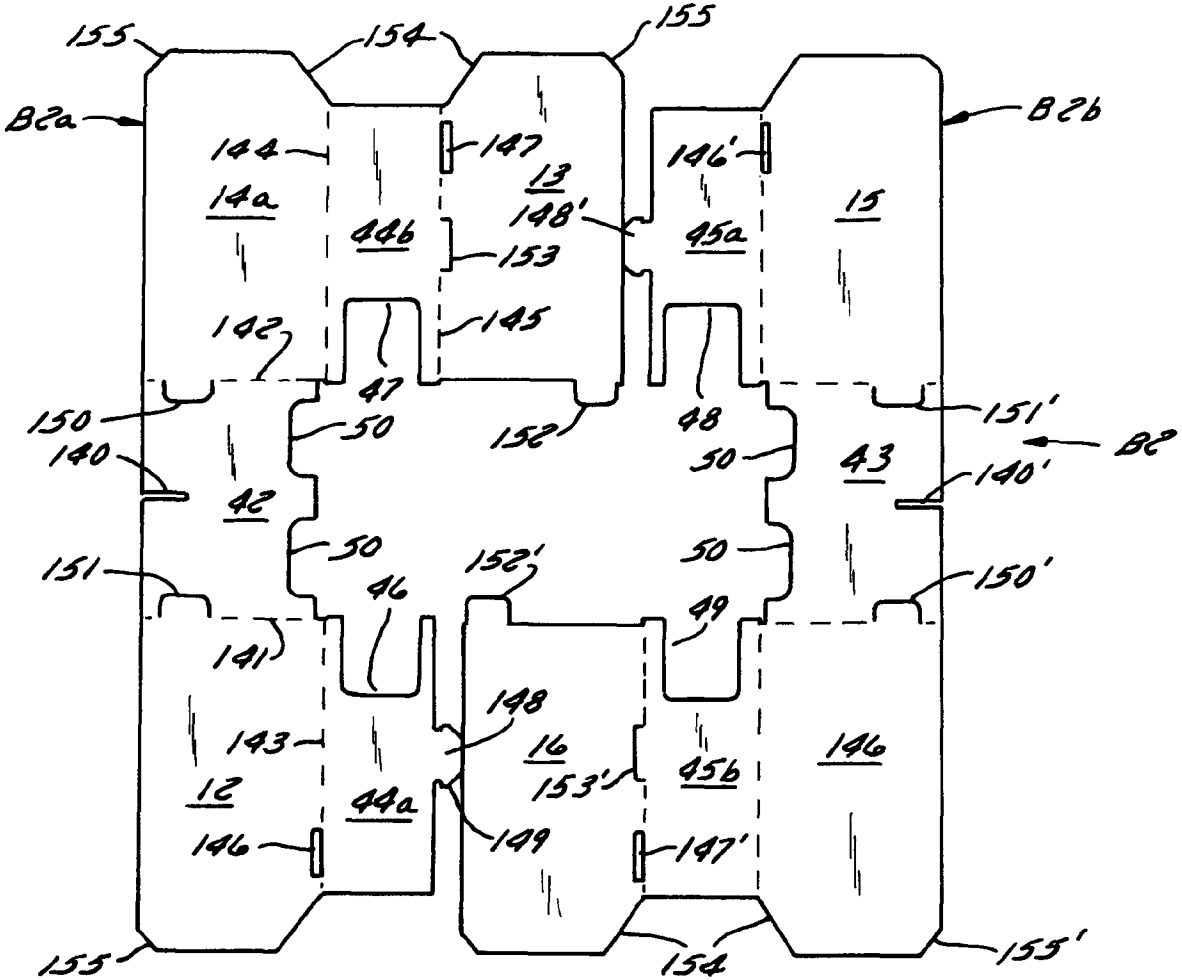
FIG. 8 is a plan view of a blank for making an insert according to the invention.

A blank B2 for making the partition inserts 40 and 41 is shown in FIG. 8. It will be noted that both inserts are made from a single large blank (B2) that is scored and cut into two separate, substantially identical blanks B2*a* and B2*b*. Since the blank portions B2*a* and B2*b* are identical, either can be used to make either of the inserts 40 or 41. As shown in FIG. 8, blank portion B2*a* is used to make insert 40 and blank portion B2*b* is used to make insert 41.

Figure 2:
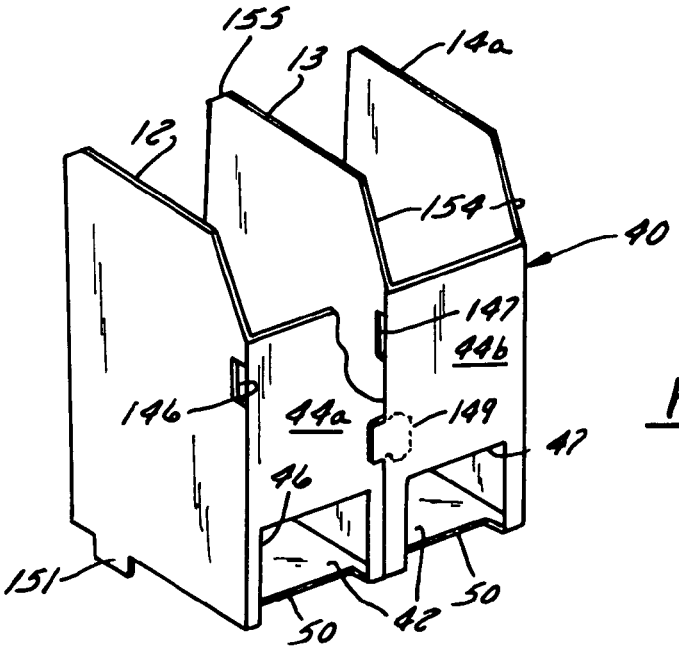
FIG. 2 is a slightly enlarged front perspective view of an insert as used in a preferred embodiment of the display container of the invention.
Figure 21:
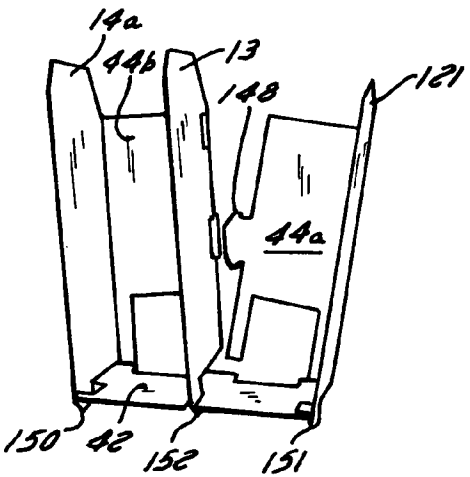
Figure 18:
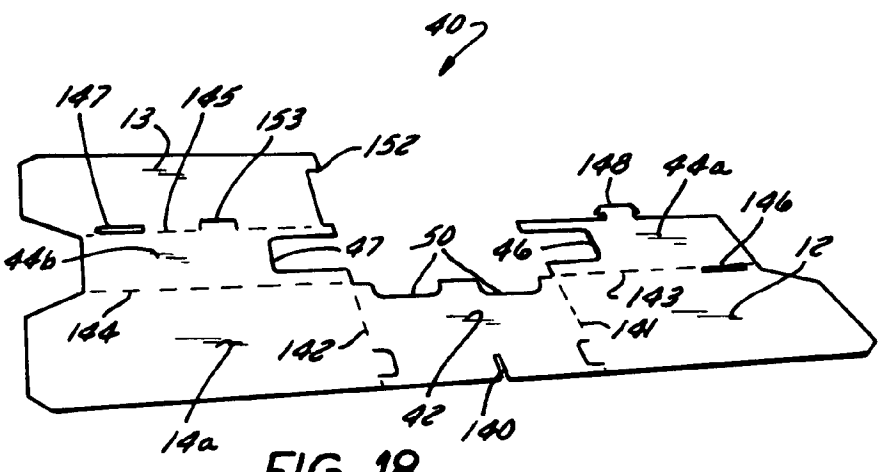
Figure 20:
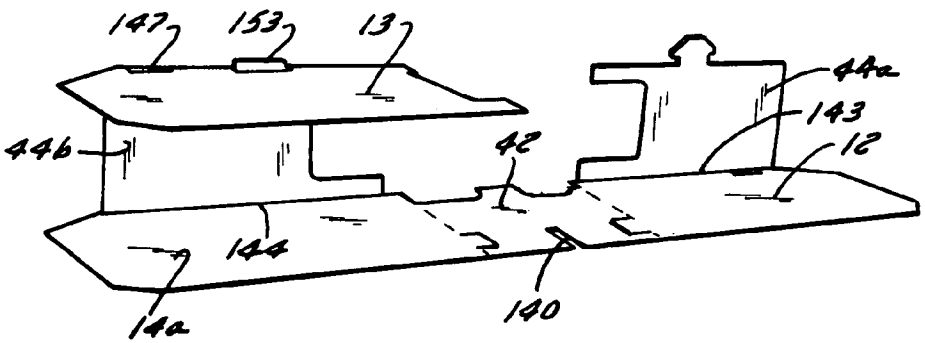

Blank B2*a* comprises a bottom wall panel 42 that forms the bottom wall of the insert 40 erected from the blank (see, e.g., FIG. 2). One edge of the bottom panel has a pair of cut-outs 50 that form the recessed edges 50 in the insert erected from the blank, and a slot 140 is formed in the panel closely adjacent the opposite edge, extending perpendicular to the edge and spaced intermediate the length of the edge. Partition panels 12 and 14*a* are foldably joined to opposite side edges of the bottom wall panel 42 along fold lines 141 and 142, and front wall panels 44*a* and 44*b* are foldably joined along respective fold lines 143 and 144 to side edges of panels 12 and 14*a* respectively. A third partition panel 13 is foldably joined along a fold line 145 to the side of panel 44*b* opposite the side connected to fold line 144. That edge of front wall panel 44*a* that is adjacent the fold line 141 has a cut-out 46, and a similar cut-out 47 is formed in the edge of panel 44*b* that is adjacent the fold 142. These cut-outs form the openings 46 and 47, respectively, in the erected insert. A slot 146 is formed in panel 12 closely adjacent fold line 143, and a similar slot 147 is formed in panel 13. A locking tab 148 is formed on the edge of panel 44*a* opposite the fold 143, and opposite sides of the tab 148 are undercut at 149 to define detent shoulders that hold the tab in a complemental slot when it is inserted through the slot. The folds 141 and 142 are interrupted by shaped cuts extending into the panel 42 so that when the panels 12 and 14*a* are folded upwardly about the folds 141 and 142 downwardly projecting tabs 150 and 151 are formed (see, e.g., FIG. 21). A similar tab 152 projects from the lower edge of panel 13. Fold line 145 between panels 13 and 44*b* also is interrupted by a shaped cut 153 extending into panel 13 so that when the panels 13 and 44*b* are folded about the fold line 145 a slot is formed in the edge of panel 13 for cooperation with the locking tab 148 in an insert erected from the blank (see, e.g., FIG. 21). The corners of partition panels 12, 13 and 14*a* adjacent the respective front wall panels 44*a* and 44*b* are cut away at 154, and the opposite corners are similarly cut away at 155, although to a lesser extent than the corners 154.

Blank B2*b* is substantially identically constructed and like parts are identified by like reference characters primed. A detailed description of blank B2*b* is not provided, except to note that partition panel 14*b* in an insert 41 made from the blank B2*b* lies against partition panel 14*a* in an insert 40 to form the central partition 14 when the inserts are placed in a box 11 (see, e.g. FIG. 1).

In a preferred construction the paperboard from which the box and the inserts are made is an E flute bright white liner board (Brite Top) having an edge crush test (ECT) value of 32. It should be understood, however, that other materials and weights can be used, depending upon the package size, articles being packaged, and results that are desired. If corrugated material is used the blank preferably is cut so that the flutes run vertically.

Figure 10:
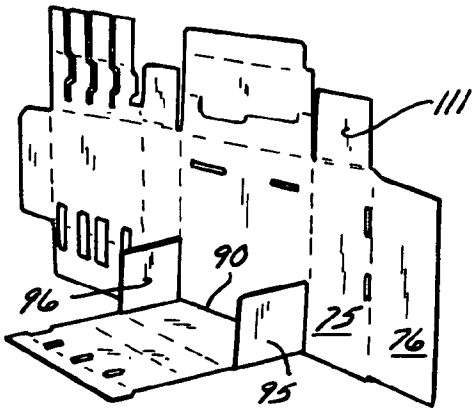
FIGS. 9-17 are perspective views illustrating the steps involved in erecting the dispensing container of the invention.
Figure 12:
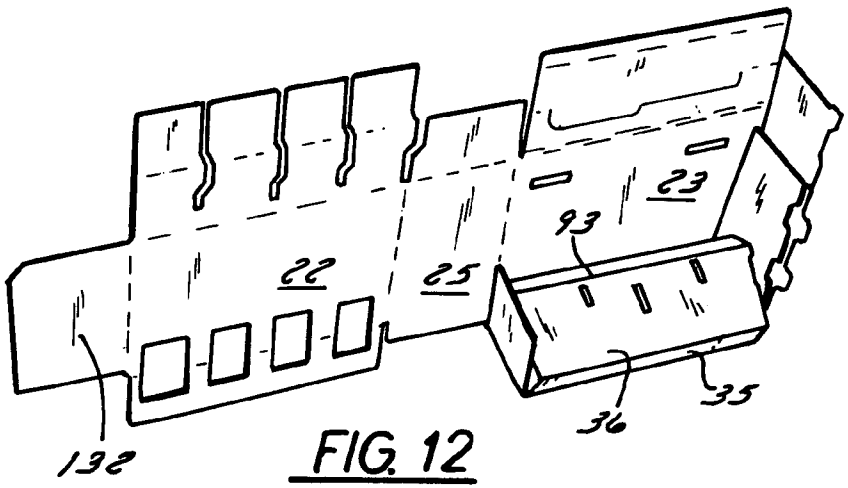
Figure 9:
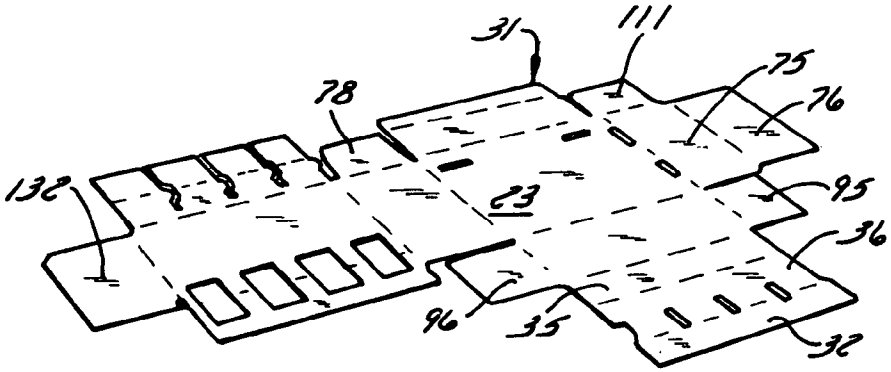
Figure 11:
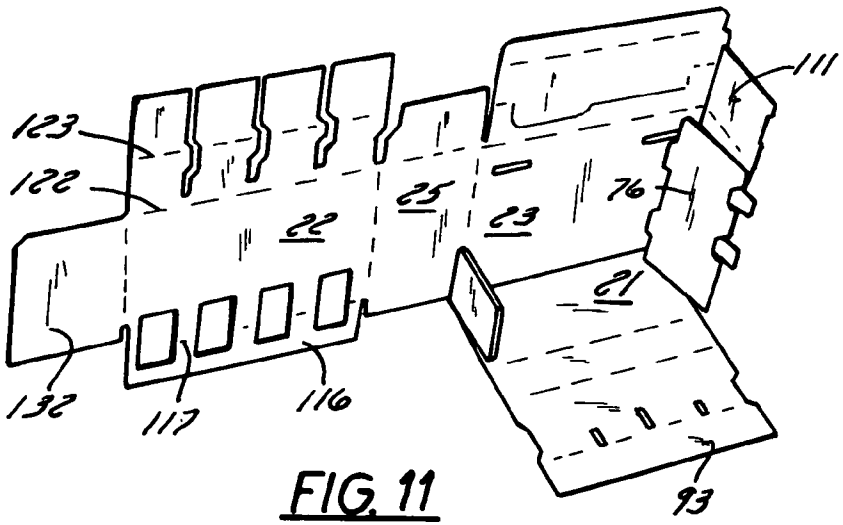
Figure 13:
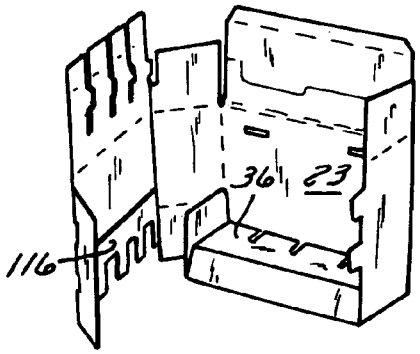
Figure 14:
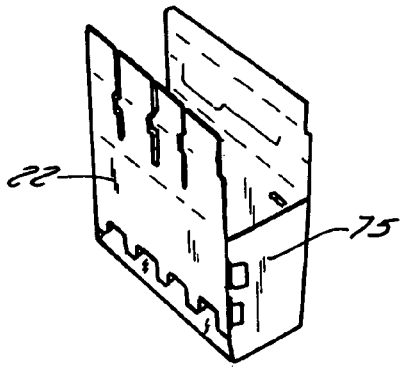

Assembly of the box 11 is depicted in FIGS. 9-11. Thus, in FIG. 9 the blank B1 is shown lying flat with the inside surface facing up. The bottom end flaps 95 and 96 are folded upwardly about fold lines 97 and 98 and that portion of the blank containing the back wall panel 23 is folded upwardly about fold line 90, as depicted in FIG. 10. As shown in FIG. 11, the outer end panel 75 is folded inwardly about fold line 65 to lie against the outside of bottom end flap 95, and the inner end panel 76 is then folded inwardly about fold line 77 to lie against the inside of bottom end flap 95, sandwiching that end flap between the inner and outer end panels. The two tabs 85 and 86 on the free edge of panel 76 are received in slots 63 and 64 in the edge of back panel 23, locking the end panels in place. It will be noted that the act of folding panel 76 relative to panel 75 results in the tabs 83 and 84 projecting outwardly generally in the plane of the panel 75. As shown in FIG. 12, panels 35 and 36 are then folded upwardly and inwardly over outer bottom panel 21 and the flap 93 is folded downwardly alongside back wall 23 to rest at its free edge on the bottom panel 21, with the opposite protruding ends of the flap 93 engaged in slots 99 and 100 at the back edges of the end flaps 95 and 96 to lock the panels 35, 36 and 93 in place, and forming the inclined panel 35 and inner bottom wall 36 spaced upwardly from outer bottom wall 21. As shown in FIG. 13, front wall flap 116 is folded upwardly about fold line 117, forming downwardly open openings 26-29 and creating a double thickness in this lower portion of the front wall. Panel 25 is then folded forwardly about fold line 110, front wall panel 22 is folded inwardly about fold line 115, and end wall panel 132 is folded inwardly about fold line 133 to extend inwardly of and lie alongside inner end wall panel 76, producing a triple wall thickness in this end of the box. The tabs 83 and 84 are then folded inwardly and inserted into the slots 134 and 135 at the front edge of end panel 132, locking the panels in place. The top end flaps 78 and 111 are folded downwardly to lie against the upper inside surface of the end walls, leaving the lid panel 31 and panels 118-121 extending upwardly, as shown in FIG. 14. As thus assembled, the box 11 is held in its erected condition entirely by interlocking tabs and slots.

Figure 19:
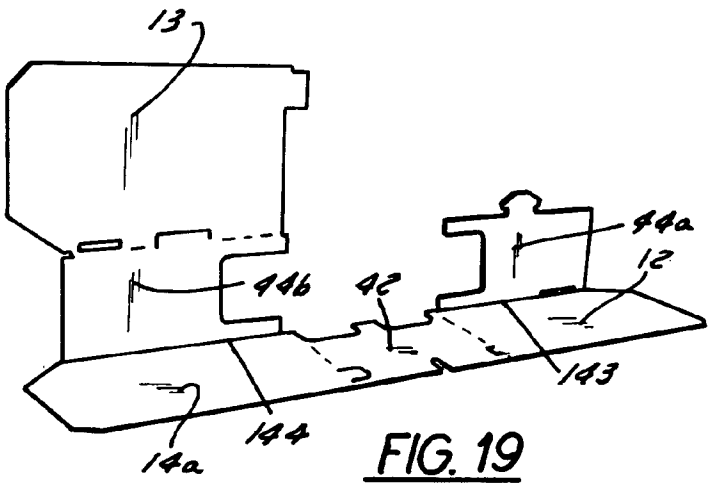
FIGS. 18-21 are perspective views illustrating the steps involved in erecting an insert according to the invention.

Assembly of the inserts 40 and 41 is depicted in FIGS. 18-21. Since the inserts are identical in construction, the assembly of only one will be described. Thus, in FIG. 18 the blank B2*a* for making insert 40 is shown lying flat with the inside (white) surface facing up. As shown in FIG. 19, panels 44*a* and 44*b* are folded upwardly about their respective fold lines 143 and 144. Panel 13 is then folded inwardly about fold line 145 to lie substantially parallel to panel 14*a*. The act of folding panel 13 relative to panel 44*b* causes the cut 153 to form a slot in the forward edge of panel 13. The panels 12 and 14*a* are then folded upwardly about their respective fold lines 141 and 142, and the locking tab 148 is inserted into the slot formed by cut 153 to lock the insert in its erected condition as shown in FIG. 2. It will be noted in FIG. 21 that the act of folding panels 12 and 14*a* upwardly causes the tabs 150 and 151 to project downwardly substantially coplanar with panels 12 and 14*a*, and the tab 152 on panel 13 is received in the slot 140 in the panel 42, whereby a tab projects downwardly below the bottom wall 42 in substantially coplanar relationship with each panel 12, 13 and 14*a*.

Figure 15:
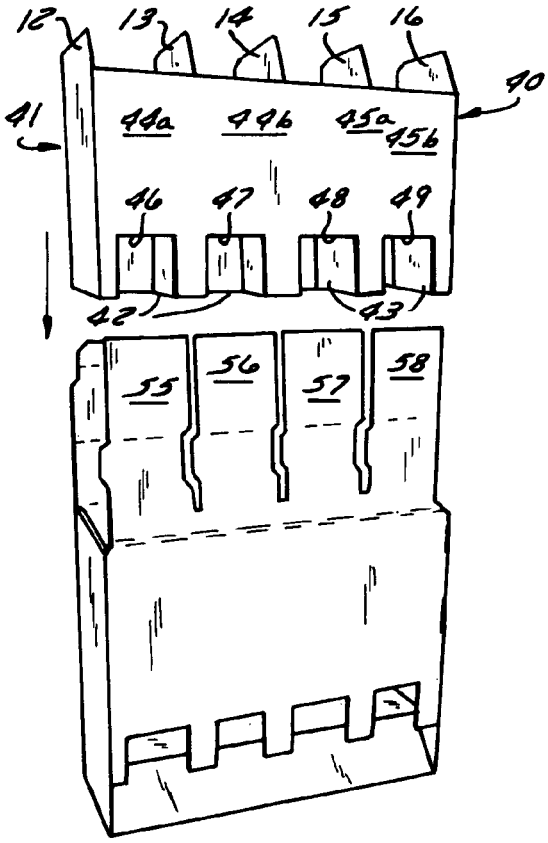
Figure 16:
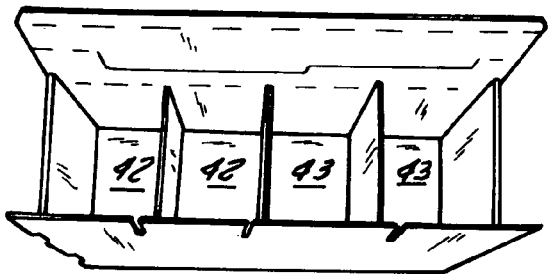
Figure 17:
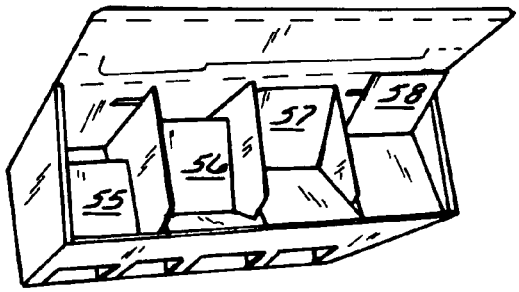

As depicted in FIGS. 15-17, the inserts 40, 41 are then placed in the box 11, with the tabs 150, 150', 151, 151', and 152, 152' projecting from the bottoms of the inserts engaged in the slots 103, 104 and 105 in the inner bottom wall 36 of the box. Articles of merchandise "A" (see FIGS. 24 and 25) can now be loaded into the compartments 17-20 defined by the inserts, and the panels 118-121 folded inwardly and downwardly so that the first portions 124-127 lie against the inner surface of the front wall 23 with the tabs 128-131 on the side edges of these panel portions engaged in the slots 146, 147, 146' and 147', respectively, formed at the front edges of the panels 12, 13, 15 and 16 to lock the panel portions in place, and the second panel portions 55-58 lying between respective pairs of panels 12-13, 13-14, 14-15 and 15-16 in a generally horizontal position over the stacks of articles. Since the natural, at-rest position of the panel portions 55-58 is generally coplanar with the panel portions 124-147, the panel portions 55-58 are readily easily flexed downwardly from their horizontal position, but they resist upward deflection from their horizontal position. Accordingly, they prevent loss of articles through the tops of the compartments during shipping and handling but enable articles to be replaced in the compartments and function to align and guide the articles as they are dropped into the compartments.

As shown in FIG. 3, in its shipping configuration the lid 31 is in a closed position over the open top of the box, with the flap 32 inserted behind the front wall 22. When it is desired to convert the container to a dispensing and display configuration at a point of sale, the lid is opened as depicted in FIG. 4, and the portion 31B pivoted forwardly relative to portion 31A about the break line defined by cuts 69, 70 and the connecting material 71, causing the connecting material to break so that the portion 31B can be rotated forward relative to portion 31A about hinges 67 and 68. The flap 32 is reinserted into the box against the back wall 23, with the portion 31B projecting vertically upwardly from the back wall and forming display panel 30 as shown in FIG. 1.

Although particular embodiments of the invention are illustrated and described in detail herein, it is to be understood that various changes and modifications may be made to the invention without departing from the spirit and intent of the invention as defined by the scope of the appended claims.

What is claimed is:

1. A gravity fed dispensing container for shipping merchandise and displaying it at a point of sale, comprising:

a box having a front wall and a plurality of partitions extending across an interior of the box, dividing it into a plurality of compartments therein for stacking articles of merchandise;

a dispensing opening in the front wall at the bottom of each of the plurality of compartments, through which the articles can be dispensed; and a yieldable panel adapted to lie over a stack of articles in each of the plurality of the compartments to prevent loss of articles through the top of the box during shipping and handling, but enabling articles to be placed in the compartment through the top, with the panel flexing downwardly to enable passage of the article and to guide the article into proper orientation as it falls into the compartment and wherein said yieldable panels are foldably connected to a top edge of said front wall; and interlocking tabs and slots on the partitions and yieldable panels hold the yieldable panels in their operative positions.

2. A dispensing container as claimed in claim 1, wherein:

means is provided on the front wall for preventing unintentional discharge or displacement of articles from the compartments both during shipping and handling and while in use at a point of display and sale, said means for preventing unintentional discharge or displacement of articles from the compartments comprising a reduced size dimension of the dispensing openings relative to a size dimension of the articles to be dispensed, so that either the article or the opening, or both, must be flexed or deformed in order to withdraw the article through the opening.

3. A dispensing container as claimed in claim 2, wherein:

the article is flexible, and the reduced size dimension is a reduced width of said at least one dispensing opening relative to the width of the article.

4. A dispensing container as claimed in claim 3, wherein:

a rearwardly sloping front-facing panel is beneath the openings to enable the articles to be pulled downwardly and forwardly through the openings.

5. A dispensing container as claimed in claim 4, wherein:

the rearwardly sloping front-facing panel has an upper edge spaced rearwardly of the front wall of the box;

the box has an outer bottom wall; and the rearwardly sloping front-facing panel terminates at its upper edge in an inner bottom wall spaced upwardly from and parallel to the outer bottom wall.

6. A gravity fed dispensing container for shipping merchandise and displaying it at a point of sale, comprising:

a box having a front wall, a back wall, and a plurality of partitions extending across an interior of the box, dividing a plurality of merchandise compartments therein for holding a stack of articles to be dispensed;

at least one dispensing opening in the front wall of the box at the bottom of said plurality of merchandise compartments, through which the articles can be dispensed;

a yieldable panel adapted to lie over the stack of articles in each of the plurality of the merchandise compartments to prevent loss of articles through the top of the box during shipping and handling, but enabling articles to be placed in the merchandise compartment through the top, with the panel flexing downwardly to enable passage of the article and to guide the article into proper orientation as it falls into the merchandise compartment and wherein said yieldable panels are foldably connected to a top edge of said front wall; and interlocking tabs and slots on the partitions and yieldable panels hold the yieldable panels in their operative positions; and means being provided on the front wall for preventing unintentional discharge or displacement of articles from the compartment both during shipping and handling and while in use at the point of display and sale, said means for preventing unintentional discharge or displacement of articles from the compartment comprising a reduced size dimension of the dispensing opening relative to a size dimension of the article to be dispensed, so that either the article or the opening, or both, must be flexed or deformed in order to withdraw the article through the opening.

7. A dispensing container as claimed in claim 1, wherein:

the article is flexible, and the reduced size dimension is a reduced width of said at least one dispensing opening relative to the width of the article.

8. A dispensing container as claimed in claim 1, wherein:

a rearwardly sloping front-facing panel is beneath the openings to enable the articles to be pulled downwardly and forwardly through the openings.

9. A dispensing container as claimed in claim 8, wherein:

the sloping front-facing panel provides a graphics panel facing in an optimum direction for viewing by a customer.

10. A dispensing container as claimed in claim 1, wherein:

at least one separate partition insert is in the box, dividing the interior of the box into a plurality of compartments for stacking articles to be dispensed, wherein the box and insert are each held assembled and are held assembled to each other by interfitting tabs and slots, whereby the use of adhesive is not necessary.

11. A dispensing container as claimed in claim 10, wherein:

there are two partition inserts, each defining two stacking compartments.

12. A dispensing container as claimed in claim 8, wherein:

the rearwardly sloping front-facing panel has an upper edge spaced rearwardly of the front wall of the box.

13. A dispensing container as claimed in claim 12, wherein:

the box has an outer bottom wall; and the rearwardly sloping front-facing panel terminates at its upper edge in an inner bottom wall spaced upwardly from and parallel to the outer bottom wall.

14. A dispensing container for shipping articles of merchandise to a point of sale and then displaying and dispensing the articles at the point of sale, comprising:

a box having a front wall and a back wall;

a lid pivoted along a back edge to a top edge of the back wall and having a flap on a forward edge that is inserted into the box behind the front wall when the lid is pivoted closed during shipping and storage;

a plurality of partitions extending across an interior of the box, dividing it into a plurality of compartments, said partitions being formed on separate inserts placed in the box;

a dispensing opening is provided in the front wall at the bottom of each compartment, said dispensing openings each having a width less than the width of an associated compartment to prevent unintentional movement of an article through the opening;

a yieldable panel adapted to lie over the stack of articles in each of the plurality of the merchandise compartments to prevent loss of articles through the top of the box during shipping and handling, but enabling articles to be placed in the merchandise compartment through the top, with the panel flexing downwardly to enable passage of the article and to guide the article into proper orientation as it falls into the merchandise compartment and a the yieldable panel being provided in each compartment wherein said yieldable panels are foldably connected to a top edge of said front wall;

interlocking tabs and slots on the partitions and yieldable panels hold the yieldable panels in their operative positions; and said lid having a transverse break line between the forward and back edges that enable the lid to be folded about the break line and the flap inserted into the box adjacent to back wall to form a display panel extending upwardly from the back wall, whereby the lid is convertible from a shipping configuration to a display configuration by the simple act of opening the lid, folding it in half about the break line, and reinserting the lid flap into the container and against the back wall to hold the display panel erect.

15. A dispensing container as claimed in claim 14, wherein:

a rearwardly sloping front-facing panel is beneath the openings to enable the articles to be pulled downwardly and forwardly through the openings.

16. A dispensing container as claimed in claim 15, wherein:

the box has an outer bottom wall; and the rearwardly sloping front-facing panel terminates at its upper edge in an inner bottom wall spaced upwardly from and parallel to the outer bottom wall.

* * * * *

UNITED STATES PATENT AND TRADEMARK OFFICE

CERTIFICATE OF CORRECTION

PATENT NO. : 8,136,697 B2
APPLICATION NO. : 12/151000
DATED : March 20, 2012
INVENTOR(S) : Francois Marion It is certified that error appears in the above-identified patent and that said Letters Patent is hereby corrected as shown below:

Please delete patent 8,136,697 B2 in its entirety and insert patent 8,136,697 B2 in its entirety.

Signed and Sealed this
Fourteenth Day of January, 2014

Michelle K. Lee

Michelle K. Lee
*Deputy Director of the United States Patent and Trademark Office*

(12) United States Patent
Hackney

(10) Patent No.: US 8,136,697 B2
(45) Date of Patent: Mar. 20, 2012

(54) GRAVITY FED DISPENSING CONTAINER

(75) Inventor: Clark K. Hackney, Midlothian, TX (US)

(73) Assignee: International Paper Company, Memphis, TN (US)

( * ) Notice: Subject to any disclaimer, the term of this patent is extended or adjusted under 35 U.S.C. 154(b) by 525 days.

(21) Appl. No.: 12/151,000

(22) Filed: May 2, 2008

(65) Prior Publication Data

US 2009/0272756 A1 Nov. 5, 2009

(51) Int. Cl.
*A47F 1/04* (2006.01)
*B65D 83/00* (2006.01)

(52) U.S. Cl. ..... 221/305; 221/303

(58) Field of Classification Search ..... 221/30–34, 221/45, 46, 56, 59–64, 68, 69, 92, 151, 152, 221/175, 176, 197, 281, 282, 286, 287, 303, 221/305, 312 C
See application file for complete search history.

(56) References Cited

U.S. PATENT DOCUMENTS

| | | | | | |
|---|---|---|---|---|---|
| 1,189,779 | A | | 7/1916 | Becker | |
| 1,682,838 | A | | 9/1928 | Feigelman | |
| 1,889,232 | A | * | 11/1932 | Ware | 221/64 |
| 1,898,646 | A | * | 2/1933 | Taylor | 229/122.1 |
| 1,966,676 | A | | 7/1934 | Marsh | |
| 1,972,406 | A | | 9/1934 | Marsh | |
| 1,974,926 | A | | 9/1934 | Marsh | |
| 2,126,461 | A | * | 8/1938 | Graham | 206/731 |
| RE21,398 | E | * | 3/1940 | Nils Thor | 221/55 |
| 2,216,324 | A | * | 10/1940 | Ringler | 221/45 |
| 2,299,027 | A | * | 10/1942 | Novak | 229/122.1 |
| 2,663,490 | A | * | 12/1953 | Bernard et al. | 229/120.04 |
| 3,040,952 | A | * | 6/1962 | Garman | 229/121 |
| 3,156,378 | A | * | 11/1964 | Bua | 221/197 |
| 3,204,762 | A | | 9/1965 | Shanok et al. | |
| 3,450,308 | A | * | 6/1969 | Schoenefeld | 221/305 |
| 4,170,325 | A | * | 10/1979 | Pawlowski et al. | 206/526 |
| 4,382,526 | A | * | 5/1983 | Stone | 221/34 |
| 4,530,548 | A | * | 7/1985 | Spamer et al. | 312/45 |
| 4,538,726 | A | * | 9/1985 | Pastva | 206/449 |
| 4,643,334 | A | * | 2/1987 | Steele | 221/63 |
| 4,767,022 | A | * | 8/1988 | Oldorf | 221/92 |
| 4,805,765 | A | | 2/1989 | Barrett et al. | |
| D302,949 | S | * | 8/1989 | Eisendrath | D9/733 |
| 5,322,185 | A | * | 6/1994 | Leight | 221/2 |
| 5,447,253 | A | * | 9/1995 | Williams | 221/92 |
| 5,642,837 | A | * | 7/1997 | Hayes et al. | 221/197 |
| 5,887,707 | A | * | 3/1999 | Anascavage et al. | 206/63.5 |
| 6,168,088 | B1 | | 1/2001 | Mobley | |
| 6,189,729 | B1 | * | 2/2001 | Keller | 221/45 |

(Continued)

*Primary Examiner* — Gene Crawford
*Assistant Examiner* — Kelvin L Randall, Jr.
(74) *Attorney, Agent, or Firm* — Matthew M. Eslami

(57) ABSTRACT

A gravity fed dispensing and display box has separate partition inserts therein dividing the interior into a plurality of compartments for stacking articles to be dispensed. A dispensing opening at the bottom of each compartment has a width less than the width of the compartment and of articles to be dispensed to prevent unintentional movement of an article through the opening. A yieldable retaining panel overlies the articles in each compartment to prevent loss of articles through the top during shipping, but flexes downwardly to enable an article to be placed in the compartment through the top. A lid is convertible from a shipping closure to a display panel for display at a point of sale. The box and the inserts are each held assembled by interlocking tabs and slots, avoiding the need for adhesive.

16 Claims, 9 Drawing Sheets

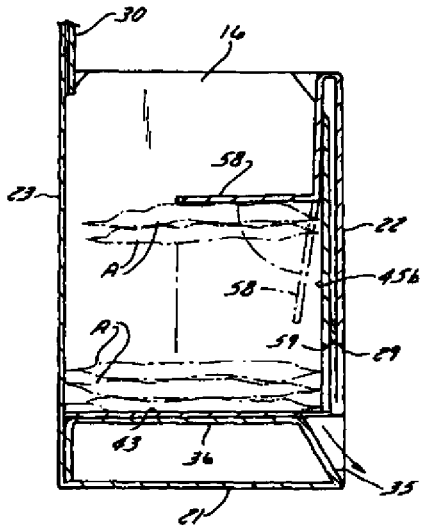

U.S. PATENT DOCUMENTS 6,237,757 B1 5/2001 Alpern
D619,891 S * 7/2010 Lymn et al. ..... D9/432
2004/0011859 A1 * 1/2004 Lo Duca ..... 229/120.18

* cited by examiner

GRAVITY FED DISPENSING CONTAINER

TECHNICAL FIELD

This invention relates generally to packaging, and more particularly to a gravity fed dispensing container.

BACKGROUND ART

Many products are shipped in containers that can be used to dispense the product when it reaches a point of sale. Exemplary of such containers are those disclosed in U.S. Pat. Nos. 1,896,646 and 1,966,676.

The dispensing container disclosed in the '646 patent comprises a display box and separate partition members inserted into the box to define a plurality of compartments in which articles to be dispensed are stacked. Dispensing openings are provided in the front of the box at the base of the compartments for withdrawing articles from the bottom of the respective stacks. These openings have the same width as the width of the compartments. Window openings are also provided in the front of the box, through with the articles supported in the stacks can be viewed, and these openings are of less width than the compartments. The box is held assembled by glue panels, and the partition inserts are secured by interfitting tabs and slots on the inserts and box. A display panel extension on the top of the front wall of the box can be raised for display at the point of sale, or for shipping can be folded flat against the lid that closes the top of the box. The box and partition members are adapted to be shipped in a flattened condition and opened up and loaded with merchandise by the retailer. In a modification, a slight lip on the front wall extends up into the bottom of the dispensing opening to keep a bottom article from protruding through the opening or coming out entirely when not intended. However, because the width of the dispensing openings is the same as the width of the compartments, it is possible that when a bottom article is withdrawn through the opening a next adjacent article may also be inadvertently withdrawn.

The dispensing container disclosed in the '676 patent comprises a display box housing and separate cartridge members inserted into the box for holding merchandise and dispensing it through openings in the front of the box. The housing is adapted to receive two cartridges, each forming two compartments for stacking merchandise. A separate shelf unit is assembled to the bottom of the box for receiving the merchandise as it is dispensed through the openings. Adhesive is used to hold the dispensing container assembled. The container is particularly adapted for holding and dispensing canned goods, including different kinds of canned goods in the different compartments. The dispensing openings at the bottoms of the compartments appear to be of the same width as the compartments, whereby the lowermost article in a stack can move through the opening and onto the shelf.

It would be desirable to have a dispensing container for shipping merchandise and displaying it at a point of sale, wherein the container has at least one merchandise compartment with a dispensing opening at the bottom and means for preventing unintentional discharge or displacement of articles from the compartment, both during shipment and handling and while in use at the point of display and sale.

It would also be desirable to have a dispensing container that is held assembled by interfitting tabs and slots, whereby the use of adhesive is not necessary.

It would further be desirable to have a dispensing container that comprises a display box having at least one separate partition insert therein dividing the interior of the box into a plurality of stacking compartments, wherein the box and insert are each held assembled and are held assembled to each other by interfitting tabs and slots.

Another desirable feature would be to have a dispensing container that comprises a box having at least one compartment therein for stacking articles of merchandise, with a dispensing opening at the bottom for dispensing articles of merchandise, and a yieldable panel at the top for preventing loss of articles through the top of the compartment during shipping and handling, but enabling articles to be placed in the compartment through the top, with the panel yielding to guide the article into proper orientation as it falls into the compartment.

Yet another desirable feature would be to have a dispensing container with a lid or top cover that can be converted into an upstanding display panel by the simple act of opening the lid, folding it in half about a break line, and reinserting the lid flap into the container.

DISCLOSURE OF THE INVENTION

The present invention comprises a gravity fed dispensing container for shipping merchandise and displaying it at a point of sale, wherein the container has at least one merchandise compartment with a dispensing opening at the bottom, and means for preventing unintentional discharge or displacement of articles from the compartment both during shipping and handling and while in use at the point of display and sale. The means for preventing unintentional discharge or displacement of articles from the compartment comprises a reduced size dimension of the dispensing opening relative to a size dimension of the article to be dispensed, so that either the article or the opening, or both, must be flexed or deformed in order to withdraw the article through the opening. In a preferred embodiment the article is flexible, the reduced size dimension is a reduced width of the dispensing opening, and a rearwardly sloping front-facing panel is beneath the openings to enable the articles to be pulled downwardly and forwardly through the opening. The sloping front-facing panel also provides a graphics panel facing in an optimum direction for viewing by a customer.

In a preferred embodiment the dispensing container of the invention comprises a dispensing box having at least one separate partition insert therein dividing the interior of the box into a plurality of compartments or columns for stacking articles to be dispensed, wherein the box and insert are each held assembled and are held assembled to each other by interfitting tabs and slots, whereby the use of adhesive is not necessary. In a preferred embodiment two inserts are provided, each defining two stacking compartments.

The dispensing container of the invention comprises a dispensing box having at least one compartment therein for stacking articles of merchandise, with a dispensing opening at the bottom of the compartment through which the articles are dispensed, and a yieldable panel at the top that lies over a stack of articles in the compartment to prevent loss of articles through the top of the box during shipping and handling, but enabling articles to be placed in the compartment through the top, with the panel flexing downwardly to enable passage of the article and to guide the article into proper orientation as it falls into the compartment.

The dispensing container of the invention comprises a dispensing box with a lid or top cover pivoted along one edge to a back wall of the box, with a flap on a forward edge of the lid that is inserted into the box behind the front wall when the lid is pivoted closed across the top end of the box for shipping and storage, but which can be converted into an upstanding display panel by the simple act of opening the lid, folding it in half about a break line, and reinserting the lid flap into the container and against the back wall to hold the display panel erect.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein:

FIG. 1 is a perspective view of the dispensing container of the invention, looking toward the front of the container, and with the container in its display configuration.

FIG. 2 is a slightly enlarged front perspective view of an insert as used in a preferred embodiment of the display container of the invention.

FIGS. 3-6 are fragmentary perspective views showing the steps involved in moving the lid of the container from its closed shipping position (FIG. 3) to its erect display position (FIG. 1).

FIG. 7 is an outside plan view of a blank for making the dispensing box of the invention.

FIG. 8 is a plan view of a blank for making an insert according to the invention.

FIGS. 9-17 are perspective views illustrating the steps involved in erecting the dispensing container of the invention.

FIGS. 18-21 are perspective views illustrating the steps involved in erecting an insert according to the invention.

Figure 22:
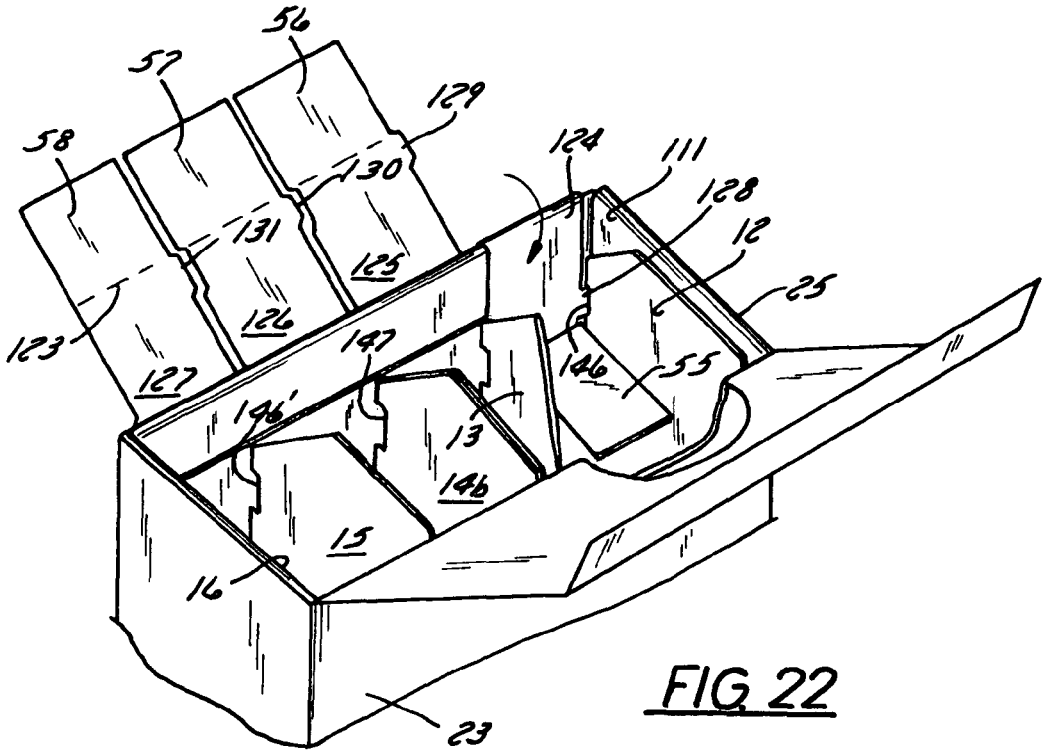
FIG. 22 is a fragmentary, top, rear perspective view of the container according to the invention, with portions broken away, showing how the retaining and guiding panels are locked into place.

FIG. 22 is a fragmentary, top, rear perspective view of the container according to the invention, with portions broken away, showing how the retaining and guiding panels are locked into place.

Figure 23:
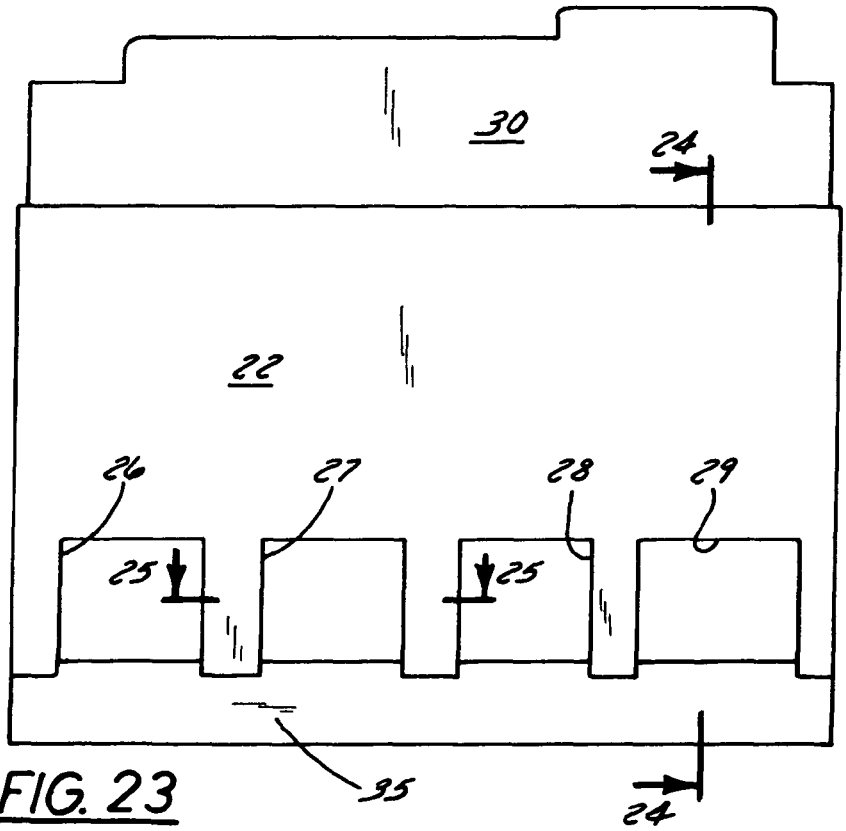
FIG. 23 is a front view in elevation of the container according to the invention.

FIG. 23 is a front view in elevation of the container according to the invention.

Figure 24:
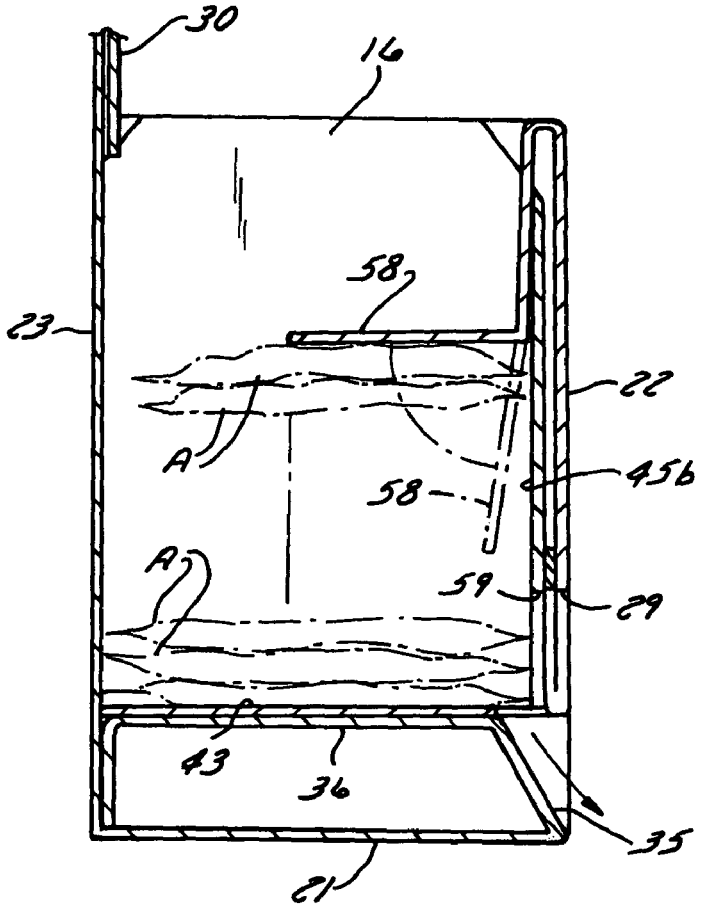
FIG. 24 is a view in section taken along line 24-24 in FIG. 23, showing a plurality of articles stacked in a compartment, and depicting how the retaining and guiding panel flexes downwardly to enable articles to be replaced in the compartment.

FIG. 24 is a view in section taken along line 24-24 in FIG. 23, showing a plurality of articles stacked in a compartment, and depicting how the retaining and guiding panel flexes downwardly to enable articles to be replaced in the compartment.

FIG. 25 is an enlarged fragmentary sectional view taken along line 25-25 in FIG. 23, showing in dot-and-dash lines an article to be dispensed.

BEST MODE FOR CARRYING OUT THE INVENTION

A dispensing container according to the invention is indicated generally at 10 in FIG. 1, where the container is shown in its display configuration for use at a point of sale. The container comprises a dispensing box 11 having a plurality of partitions 12, 13, 14, 15 and 16 therein dividing the interior of the box into a plurality of compartments 17, 18, 19 and 20 for stacking articles of merchandise to be dispensed (not shown in this figure). The box has an outer bottom wall 21, a front wall 22, a back wall 23, and opposite end walls 24 and 25. A plurality of dispensing openings 26, 27, 28 and 29 are formed in a lower portion of the front wall, with each opening in aligned registry with a respective one of the compartments 17-20.

A display panel 30 projects upwardly from an upper edge of the back wall, and as seen best in FIGS. 3 and 4 the display panel is formed by reconfiguring a lid 31 pivotally attached to an upper edge of the back wall. The lid 31 has a down-turned flap 32 on its forward edge that is inserted into the container behind the front wall to hold the lid in a closed position over the top end of the box during shipping and handling, but as explained more fully hereinafter, the lid can be reconfigured from its closed shipping configuration shown in FIG. 3 to form the display panel 30 shown in FIG. 1.

An inclined panel 35 extends upwardly and rearwardly from the front edge of the outer bottom wall 21 and terminates at its upper edge in an inner bottom wall 36 that extends horizontally across the interior of the box in upwardly spaced relation to the outer bottom wall 21. The interior bottom wall is substantially coplanar with the open lower edge of the dispensing openings 26-29, but its forward edge 37, and the upper edge of the inclined panel, are spaced behind the front wall 22 (see FIGS. 24 and 25).

The partitions 12-16 and associated compartments 17-20 are formed by two inserts 40 and 41 (see FIGS. 2 and 15) that have bottom walls 42 and 43, respectively, front wall panels 44*a*, 44*b* and 45*a*, 45*b*, respectively, and open backs. Openings 46, 47 and 48, 49 are formed in the front wall panels 44*a*, 44*b* and 45*a*, 45*b*, respectively, and these openings are in aligned registry with the openings 26-29 in the front wall of the box when the inserts are placed in the box. The inserts are placed in the box so that the bottom walls 42 and 43 of the inserts rest on top of the interior bottom wall 36 of the box, and the front wall panels 44*a*, 44*b* and 45*a*, 45*b* lie against the inner surface of the box front wall.

As seen best in FIGS. 1, 2, 24 and 25, the forward edges of the bottom walls 42 and 43 of the inserts, in the area behind each dispensing opening, are recessed at 50 so that the recessed edges lie substantially in registry with the top edge of the rearwardly inclined panel 35.

As seen best in FIG. 25 the width of the dispensing openings 26-29 and 46-49 is less than the width of the respective compartments as defined by the partitions. In a preferred embodiment it is contemplated that the articles "A" to be stacked in the compartments and dispensed through the openings will have a width slightly greater than the width of the openings whereby they will be restrained against inadvertent discharge through the openings, but they and/or the structure surrounding the openings can be slightly flexed to permit the articles to be withdrawn through the openings when desired.

Retaining and guiding panels 55, 56, 57 and 58 are foldably connected to the upper edge of the front wall 22 and are folded inwardly to extend between the partitions and lie over the tops of stacks of articles contained in the compartments. These panels resist upward deflection and thereby help to secure articles in the stack and prevent their ejection through the top ends of the compartments during shipping and handling, but they readily flex downwardly from their horizontal position and function to guide and align articles into proper orientation on a stack of articles in the compartment when articles are replaced in the compartments following initial filling (see FIG. 24).

The foregoing structure is well suited to stacking and dispensing small flat articles that are somewhat flexible or at least have flexible edges. The articles preferably have a width approximately the same as the width of the respective compartments, but slightly greater than the width of the dispensing openings. To remove a bottom article from a stack of the articles in one of the compartments, the front edge of the article is grasped and pulled forwardly and slightly downwardly against the inclined panel, causing the opposite side edges of the article to deflect and enabling the article to be withdrawn through the opening. The slight oversize of the articles prevents them from unintentionally passing through the dispensing openings during shipping and handling. Further, when a bottom article is being withdrawn from the stack the next adjacent article is held in place by the side edges of the opening and is not inadvertently withdrawn along with the article selected.

A blank B1 for making the dispensing box 11 in the container of the invention is shown in FIG. 7. The blank comprises a single piece of paperboard, cut and scored to define a rear wall panel 23 that forms the rear wall in the erected box. In a preferred embodiment the paperboard comprises E-flute Brite Top (white liner board) having an edge crush test value (ECT) of 32, folded and cut so that the corrugations extend vertically in the erected box. It should be understood, however, that other suitable materials could be used depending upon the characteristics desired. A pair of slots 60 and 61 is formed in the panel 23 near a fold line 62 that defines the top edge of the rear wall in a box erected from the blank, and these slots can be used to hang the dispensing container from hooks or other support devices at the point of sale. A second pair of smaller slots 63 and 64 is formed in the panel 23 closely adjacent a fold line 65 at one side edge of the panel, for a purpose hereinafter described.

A lid panel 31 is foldably attached to the rear wall panel 23 along the fold line 62, and a lid flap panel 32 is foldably attached to the free edge of panel 31 along a fold line 66. Short scores 67 and 68 substantially along a midline of panel 31 at its opposite side edges define hinges, and a series of cuts 69 and closely spaced slits 70 extend between the scores 67 and 68 to define a break line. The hinges and break line divide the lid panel into two parts, 31A and 31B that can be folded relative to one another to reconfigure the lid into the display panel 30 as explained more fully hereinafter. The connecting material 71 between the closely spaced slits prevent the lid from folding about the break line until deliberate action is taken to fold the lid to produce the display panel 30.

An outer end wall panel 75 is foldably connected to the side edge of panel 23 along fold line 65, and an inner end wall panel 76 is foldably connected to the outer edge of panel 75 along fold line 77. Panels 75 and 76 form the end wall 24 in the erected box. A first top end wall flap 78 is foldably connected to an edge of panel 75 along fold line 79 and has a notch 80 cut in one side edge thereof. Shaped cuts 81 and 82 define locking tabs 83 and 84, respectively, extending across the fold line 77, and locking tabs 85 and 86 are formed on the outer free edge of panel 76.

An outer bottom wall panel 21 is foldably attached along a fold line 90 to the edge of the back wall panel 23 opposite the edge to which the lid panel is attached and forms the outer bottom wall in the erected box. Panel 35 is foldably connected along a fold line 91 at one edge thereof to the opposite edge of outer bottom wall panel 21 and forms the inclined panel 35 in the erected box. An inner bottom wall panel 36 is foldably connected along a fold line 92 at one edge thereof to the opposite edge of panel 35, and a flap panel 93 is foldably connected along a fold line 94 to the opposite edge of panel 36. First and second bottom end wall flaps 95 and 96 are foldably connected along fold lines 97 and 98, respectively, to opposite ends of the outer bottom wall panel 21, and the edges of these end wall flaps adjacent the fold line 90 have notches 99 and 100 therein, respectively. Similarly, notches 101 and 102 are formed in the outer end edges of panel 36 adjacent fold line 94, and a slot 103 is formed in panel 36 intermediate its ends and adjacent fold line 94. Additional slots 104 and 105 are formed in panel 36 adjacent the fold line 94 and intermediate the slot 103 and the opposite ends of the panel.

End wall panel 25 is foldably joined along a fold line 110 to the edge of panel 23 opposite the edge to which panel 75 is joined, and a second top end wall flap 111 is foldably joined along a fold line 112 to the edge of panel 25 adjacent the lid panel 31. An outer side edge of panel 111 is notched at 113.

Front wall panel 22 is foldably joined along a fold line 115 to the edge of panel 25 opposite the edge connected to panel 23 and a front wall flap 116 is foldably joined to one edge of panel 22 along a fold line 117 extending perpendicular to fold line 115, so that the panel 22 has a height "h" that is less than the height of the panel 23 by approximately the same dimension as the width "w" of flap panel 93. A plurality of cut-outs 26-29 extend equidistantly on opposite sides of the fold line 117 and form the dispensing openings 26-29 in the front wall of an erected box. A plurality of panels 118, 119, 120 and 121 are foldably joined along a fold line 122 to the edge of panel 22 opposite the edge to which front wall flap 116 is joined, and each is bisected by a fold line 123 that divides the panels into first portions 124, 125, 126 and 127, respectively, and second portions 55, 56, 57 and 58 that form the retaining and guiding panels 55, 56, 57 and 58 in a box erected from the blank. The panels 118, 119, 120 and 121 are separated from one another by shaped slots that form laterally projecting tabs 128, 129, 130 and 131 on one side edge of the respective panels.

An additional end wall panel 132 is foldably joined along a fold line 133 to the edge of panel 22 opposite the edge connected to panel 25, and this fold line is interrupted by two shaped cuts 134 and 135 that form slots in panel 132 when the panel is folded relative to panel 22.

A blank B2 for making the partition inserts 40 and 41 is shown in FIG. 8. It will be noted that both inserts are made from a single large blank (B2) that is scored and cut into two separate, substantially identical blanks B2*a* and B2*b*. Since the blank portions B2*a* and B2*b* are identical, either can be used to make either of the inserts 40 or 41. As shown in FIG. 8, blank portion B2*a* is used to make insert 40 and blank portion B2*b* is used to make insert 41.

Blank B2*a* comprises a bottom wall panel 42 that forms the bottom wall of the insert 40 erected from the blank (see, e.g., FIG. 2). One edge of the bottom panel has a pair of cut-outs 50 that form the recessed edges 50 in the insert erected from the blank, and a slot 140 is formed in the panel closely adjacent the opposite edge, extending perpendicular to the edge and spaced intermediate the length of the edge. Partition panels 12 and 14*a* are foldably joined to opposite side edges of the bottom wall panel 42 along fold lines 141 and 142, and front wall panels 44*a* and 44*b* are foldably joined along respective fold lines 143 and 144 to side edges of panels 12 and 14*a* respectively. A third partition panel 13 is foldably joined along a fold line 145 to the side of panel 44*b* opposite the side connected to fold line 144. That edge of front wall panel 44*a* that is adjacent the fold line 141 has a cut-out 46, and a similar cut-out 47 is formed in the edge of panel 44*b* that is adjacent the fold 142. These cut-outs form the openings 46 and 47, respectively, in the erected insert. A slot 146 is formed in panel 12 closely adjacent fold line 143, and a similar slot 147 is formed in panel 13. A locking tab 148 is formed on the edge of panel 44*a* opposite the fold 143, and opposite sides of the tab 148 are undercut at 149 to define detent shoulders that hold the tab in a complemental slot when it is inserted through the slot. The folds 141 and 142 are interrupted by shaped cuts extending into the panel 42 so that when the panels 12 and 14*a* are folded upwardly about the folds 141 and 142 downwardly projecting tabs 150 and 151 are formed (see, e.g., FIG. 21). A similar tab 152 projects from the lower edge of panel 13. Fold line 145 between panels 13 and 44*b* also is interrupted by a shaped cut 153 extending into panel 13 so that when the panels 13 and 44*b* are folded about the fold line 145 a slot is formed in the edge of panel 13 for cooperation with the locking tab 148 in an insert erected from the blank (see, e.g., FIG. 21). The corners of partition panels 12, 13 and 14*a* adjacent the respective front wall panels 44*a* and 44*b* are cut away at 154, and the opposite corners are similarly cut away at 155, although to a lesser extent than the corners 154.

Blank B2*b* is substantially identically constructed and like parts are identified by like reference characters primed. A detailed description of blank B2*b* is not provided, except to note that partition panel 14*b* in an insert 41 made from the blank B2*b* lies against partition panel 14*a* in an insert 40 to form the central partition 14 when the inserts are placed in a box 11 (see, e.g. FIG. 1).

In a preferred construction the paperboard from which the box and the inserts are made is an E flute bright white liner board (Brite Top) having an edge crush test (ECT) value of 32. It should be understood, however, that other materials and weights can be used, depending upon the package size, articles being packaged, and results that are desired. If corrugated material is used the blank preferably is cut so that the flutes run vertically.

Assembly of the box 11 is depicted in FIGS. 9-11. Thus, in FIG. 9 the blank B1 is shown lying flat with the inside surface facing up. The bottom end flaps 95 and 96 are folded upwardly about fold lines 97 and 98 and that portion of the blank containing the back wall panel 23 is folded upwardly about fold line 90, as depicted in FIG. 10. As shown in FIG. 11, the outer end panel 75 is folded inwardly about fold line 65 to lie against the outside of bottom end flap 95, and the inner end panel 76 is then folded inwardly about fold line 77 to lie against the inside of bottom end flap 95, sandwiching that end flap between the inner and outer end panels. The two tabs 85 and 86 on the free edge of panel 76 are received in slots 63 and 64 in the edge of back panel 23, locking the end panels in place. It will be noted that the act of folding panel 76 relative to panel 75 results in the tabs 83 and 84 projecting outwardly generally in the plane of the panel 75. As shown in FIG. 12, panels 35 and 36 are then folded upwardly and inwardly over outer bottom panel 21 and the flap 93 is folded downwardly alongside back wall 23 to rest at its free edge on the bottom panel 21, with the opposite protruding ends of the flap 93 engaged in slots 99 and 100 at the back edges of the end flaps 95 and 96 to lock the panels 35, 36 and 93 in place, and forming the inclined panel 35 and inner bottom wall 36 spaced upwardly from outer bottom wall 21. As shown in FIG. 13, front wall flap 116 is folded upwardly about fold line 117, forming downwardly open openings 26-29 and creating a double thickness in this lower portion of the front wall. Panel 25 is then folded forwardly about fold line 110, front wall panel 22 is folded inwardly about fold line 115, and end wall panel 132 is folded inwardly about fold line 133 to extend inwardly of and lie alongside inner end wall panel 76, producing a triple wall thickness in this end of the box. The tabs 83 and 84 are then folded inwardly and inserted into the slots 134 and 135 at the front edge of end panel 132, locking the panels in place. The top end flaps 78 and 111 are folded downwardly to lie against the upper inside surface of the end walls, leaving the lid panel 31 and panels 118-121 extending upwardly, as shown in FIG. 14. As thus assembled, the box 11 is held in its erected condition entirely by interlocking tabs and slots.

Assembly of the inserts 40 and 41 is depicted in FIGS. 18-21. Since the inserts are identical in construction, the assembly of only one will be described. Thus, in FIG. 18 the blank B2*a* for making insert 40 is shown lying flat with the inside (white) surface facing up. As shown in FIG. 19, panels 44*a* and 44*b* are folded upwardly about their respective fold lines 143 and 144. Panel 13 is then folded inwardly about fold line 145 to lie substantially parallel to panel 14*a*. The act of folding panel 13 relative to panel 44*b* causes the cut 153 to form a slot in the forward edge of panel 13. The panels 12 and 14*a* are then folded upwardly about their respective fold lines 141 and 142, and the locking tab 148 is inserted into the slot formed by cut 153 to lock the insert in its erected condition as shown in FIG. 2. It will be noted in FIG. 21 that the act of folding panels 12 and 14*a* upwardly causes the tabs 150 and 151 to project downwardly substantially coplanar with panels 12 and 14*a*, and the tab 152 on panel 13 is received in the slot 140 in the panel 42, whereby a tab projects downwardly below the bottom wall 42 in substantially coplanar relationship with each panel 12, 13 and 14*a*.

As depicted in FIGS. 15-17, the inserts 40, 41 are then placed in the box 11, with the tabs 150, 150', 151, 151', and 152, 152' projecting from the bottoms of the inserts engaged in the slots 103, 104 and 105 in the inner bottom wall 36 of the box. Articles of merchandise "A" (see FIGS. 24 and 25) can now be loaded into the compartments 17-20 defined by the inserts, and the panels 118-121 folded inwardly and downwardly so that the first portions 124-127 lie against the inner surface of the front wall 23 with the tabs 128-131 on the side edges of these panel portions engaged in the slots 146, 147, 146' and 147', respectively, formed at the front edges of the panels 12, 13, 15 and 16 to lock the panel portions in place, and the second panel portions 55-58 lying between respective pairs of panels 12-13, 13-14, 14-15 and 15-16 in a generally horizontal position over the stacks of articles. Since the natural, at-rest position of the panel portions 55-58 is generally coplanar with the panel portions 124-147, the panel portions 55-58 are readily easily flexed downwardly from their horizontal position, but they resist upward deflection from their horizontal position. Accordingly, they prevent loss of articles through the tops of the compartments during shipping and handling but enable articles to be replaced in the compartments and function to align and guide the articles as they are dropped into the compartments.

As shown in FIG. 3, in its shipping configuration the lid 31 is in a closed position over the open top of the box, with the flap 32 inserted behind the front wall 22. When it is desired to convert the container to a dispensing and display configuration at a point of sale, the lid is opened as depicted in FIG. 4, and the portion 31B pivoted forwardly relative to portion 31A about the break line defined by cuts 69, 70 and the connecting material 71, causing the connecting material to break so that the portion 31B can be rotated forward relative to portion 31A about hinges 67 and 68. The flap 32 is reinserted into the box against the back wall 23, with the portion 31B projecting vertically upwardly from the back wall and forming display panel 30 as shown in FIG. 1.

Although particular embodiments of the invention are illustrated and described in detail herein, it is to be understood that various changes and modifications may be made to the invention without departing from the spirit and intent of the invention as defined by the scope of the appended claims.

What is claimed is:

1. A gravity fed dispensing container for shipping merchandise and displaying it at a point of sale, comprising:

a box having a front wall, a back wall, and a plurality of partitions extending across an interior of the box, dividing a plurality of merchandise compartments therein for holding a stack of articles to be dispensed;

at least one dispensing opening in the front wall of the box at the bottom of said plurality of merchandise compartments, through which the articles can be dispensed;

a yieldable panel adapted to lie over the stack of articles in each of the plurality of the merchandise compartments to prevent loss of articles through the top of the box during shipping and handling, but enabling articles to be placed in the merchandise compartment through the top, with the panel flexing downwardly to enable passage of the article and to guide the article into proper orientation as it falls into the merchandise compartment and wherein said yieldable panels are foldably connected to a top edge of said front wall; and interlocking tabs and slots on the partitions and yieldable panels hold the yieldable panels in their operative positions; and means being provided on the front wall for preventing unintentional discharge or displacement of articles from the compartment both during shipping and handling and while in use at the point of display and sale, said means for preventing unintentional discharge or displacement of articles from the compartment comprising a reduced size dimension of the dispensing opening relative to a size dimension of the article to be dispensed, so that either the article or the opening, or both, must be flexed or deformed in order to withdraw the article through the opening.

2. A dispensing container as claimed in claim 1, wherein:

the article is flexible, and the reduced size dimension is a reduced width of said at least one dispensing opening relative to the width of the article.

3. A dispensing container as claimed in claim 1, wherein:

a rearwardly sloping front-facing panel is beneath the openings to enable the articles to be pulled downwardly and forwardly through the openings.

4. A dispensing container as claimed in claim 3, wherein:

the sloping front-facing panel provides a graphics panel facing in an optimum direction for viewing by a customer.

5. A dispensing container as claimed in claim 1, wherein:

at least one separate partition insert is in the box, dividing the interior of the box into a plurality of compartments for stacking articles to be dispensed, wherein the box and insert are each held assembled and are held assembled to each other by interfitting tabs and slots, whereby the use of adhesive is not necessary.

6. A dispensing container as claimed in claim 5, wherein:

there are two partition inserts, each defining two stacking compartments.

7. A dispensing container as claimed in claim 3, wherein:

the rearwardly sloping front-facing panel has an upper edge spaced rearwardly of the front wall of the box.

8. A dispensing container as claimed in claim 7, wherein:

the box has an outer bottom wall; and the rearwardly sloping front-facing panel terminates at its upper edge in an inner bottom wall spaced upwardly from and parallel to the outer bottom wall.

9. A gravity fed dispensing container for shipping merchandise and displaying it at a point of sale, comprising:

a box having a front wall and a plurality of partitions extending across an interior of the box, dividing it into a plurality of compartments therein for stacking articles of merchandise;

a dispensing opening in the front wall at the bottom of each of the plurality of compartments, through which the articles can be dispensed; and a yieldable panel adapted to lie over a stack of articles in each of the plurality of the compartments to prevent loss of articles through the top of the box during shipping and handling, but enabling articles to be placed in the compartment through the top, with the panel flexing downwardly to enable passage of the article and to guide the article into proper orientation as it falls into the compartment and wherein said yieldable panels are foldably connected to a top edge of said front wall; and interlocking tabs and slots on the partitions and yieldable panels hold the yieldable panels in their operative positions.

10. A dispensing container as claimed in claim 9, wherein:

means is provided on the front wall for preventing unintentional discharge or displacement of articles from the compartments both during shipping and handling and while in use at a point of display and sale, said means for preventing unintentional discharge or displacement of articles from the compartments comprising a reduced size dimension of the dispensing openings relative to a size dimension of the articles to be dispensed, so that either the article or the opening, or both, must be flexed or deformed in order to withdraw the article through the opening.

11. A dispensing container as claimed in claim 10, wherein:

the article is flexible, and the reduced size dimension is a reduced width of said at least one dispensing opening relative to the width of the article.

12. A dispensing container as claimed in claim 11, wherein:

a rearwardly sloping front-facing panel is beneath the openings to enable the articles to be pulled downwardly and forwardly through the openings.

13. A dispensing container as claimed in claim 12, wherein:

the rearwardly sloping front-facing panel has an upper edge spaced rearwardly of the front wall of the box;

the box has an outer bottom wall; and the rearwardly sloping front-facing panel terminates at its upper edge in an inner bottom wall spaced upwardly from and parallel to the outer bottom wall.

14. A dispensing container for shipping articles of merchandise to a point of sale and then displaying and dispensing the articles at the point of sale, comprising:

a box having a front wall and a back wall;

a lid pivoted along a back edge to a top edge of the back wall and having a flap on a forward edge that is inserted into the box behind the front wall when the lid is pivoted closed during shipping and storage;

a plurality of partitions extending across an interior of the box, dividing it into a plurality of compartments, said partitions being formed on separate inserts placed in the box;

a dispensing opening is provided in the front wall at the bottom of each compartment, said dispensing openings each having a width less than the width of an associated compartment to prevent unintentional movement of an article through the opening;

a yieldable panel adapted to lie over the stack of articles in each of the plurality of the merchandise compartments to prevent loss of articles through the top of the box during shipping and handling, but enabling articles to be placed in the merchandise compartment through the top, with the panel flexing downwardly to enable passage of the article and to guide the article into proper orientation as it falls into the merchandise compartment and a the yieldable panel being provided in each compartment wherein said yieldable panels are foldably connected to a top edge of said front wall;

interlocking tabs and slots on the partitions and yieldable panels hold the yieldable panels in their operative positions; and said lid having a transverse break line between the forward and back edges that enable the lid to be folded about the break line and the flap inserted into the box adjacent to back wall to form a display panel extending upwardly from the back wall, whereby the lid is convertible from a shipping configuration to a display configuration by the simple act of opening the lid, folding it in half about the break line, and reinserting the lid flap into the container and against the back wall to hold the display panel erect.

15. A dispensing container as claimed in claim 14, wherein:

a rearwardly sloping front-facing panel is beneath the openings to enable the articles to be pulled downwardly and forwardly through the openings.

16. A dispensing container as claimed in claim 15, wherein:

the box has an outer bottom wall; and the rearwardly sloping front-facing panel terminates at its upper edge in an inner bottom wall spaced upwardly from and parallel to the outer bottom wall.

* * * * *